US008639174B2

(12) United States Patent
Ashikawa et al.

(10) Patent No.: US 8,639,174 B2
(45) Date of Patent: Jan. 28, 2014

(54) TO-BE-TRANSFERRED OBJECT LENGTH MEASUREMENT DEVICE AND IMAGE FORMING APPARATUS AND COMPUTER-READABLE STORAGE MEDIUM

(75) Inventors: Masahiro Ashikawa, Kanagawa (JP); Tatsuya Watahiki, Kanagawa (JP); Minoru Takahashi, Kanagawa (JP); Hideyuki Takayama, Kanagawa (JP); Takahisa Koike, Tokyo (JP); Masaru Yamagishi, Kanagawa (JP); Takuhei Minami, Kanagawa (JP); Takuro Kamiyai, Kanagawa (JP); Junya Takigawa, Tokyo (JP); Hiroaki Takagi, Kanagawa (JP); Koichi Kudo, Kanagawa (JP); Katsuya Kawagoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 280 days.

(21) Appl. No.: 12/659,716

(22) Filed: Mar. 18, 2010

(65) Prior Publication Data

US 2010/0239282 A1 Sep. 23, 2010

(30) Foreign Application Priority Data

Mar. 18, 2009 (JP) ..... 2009-065669
Feb. 26, 2010 (JP) ..... 2010-043285

(51) Int. Cl.
*G03G 15/00* (2006.01)
*G03G 15/01* (2006.01)
*G03G 15/20* (2006.01)

(52) U.S. Cl.
USPC ..... 399/389; 399/302; 399/308

(58) Field of Classification Search
USPC ..... 399/389, 302, 308
See application file for complete search history.

(56) References Cited

U.S. PATENT DOCUMENTS

2005/0127597 A1* 6/2005 Sano et al. ..... 271/258.01
2008/0226372 A1* 9/2008 Loh et al. ..... 400/76

FOREIGN PATENT DOCUMENTS

JP 05-208534 8/1993
JP 2743203 4/1998
JP 3089039 9/2000

OTHER PUBLICATIONS

Abstract of JP 04-288560 filed on Oct. 13, 1992.
Abstract of JP 03-172255 filed on Jul. 25, 1991.

* cited by examiner

*Primary Examiner* — Judy Nguyen
*Assistant Examiner* — Blake A Tankersley
(74) *Attorney, Agent, or Firm* — Harness, Dickey & Pierce P.L.C.

(57) ABSTRACT

A disclosed to-be-transferred object length measurement device includes a first rotating body; a passage detection unit detecting a passage of the to-be-transferred object; a rotation amount measurement unit measuring a rotation amount of the first rotating body in a first measurement period; a second rotating body feeding the to-be-transferred object; a speed detection unit detecting a first feeding speed and a second feeding speed of the to-be-transferred object; and a calculation unit calculating a feeding distance of the to-be-transferred object per a predetermined rotation amount of the first rotating body based on the first feeding speed, and further calculating a length of the to-be-transferred object based on the rotation amount of the first rotating body in the first measurement period, the feeding distance, and the second feeding speed of the to-be-transferred object in the second measurement period.

18 Claims, 12 Drawing Sheets

TO-BE-TRANSFERRED OBJECT LENGTH MEASUREMENT DEVICE AND IMAGE FORMING APPARATUS AND COMPUTER-READABLE STORAGE MEDIUM

CROSS-REFERENCE TO RELATED APPLICATIONS

The present application claims priority under 35 U.S.C §119 to Japanese Patent Application Nos. 2009-065669, filed Mar. 18, 2009, and 2010-043285, filed Feb. 26, 2010, the entire contents of which are hereby incorporated herein by reference.

BACKGROUND OF THE INVENTION

1. Field of the Invention

The present invention generally relates to a to-be-transferred object length measurement device capable of measuring a length of a to-be-transferred object on which an image is transferred, and an image forming apparatus and a computer-readable storage medium.

2. Description of the Related Art

In an image forming apparatus capable of forming a prescribed image while feeding a recording sheet (i.e., a to-be-transferred object) in the sheet feeding path where feeding rollers are provided, there is a known to-be-transferred object length measurement method of measuring a size (length) of the recording sheet as the to-be-transferred object. More specifically, in the to-be-transferred object length measurement method, the size (length) of the recording sheet as the to-be-transferred object is measured by using at least one to-be-transferred object detection sensor provided in the recording sheet feeding path, measuring a time period from when the feeding roller is started to be rotated to when the to-be-transferred object detection sensor detects the passage of the tail end of the recoding sheet, and calculating using the measured time period and the feeding speed of the feeding roller (see, for example, Japanese Patent Application Publication No. 03-172255).

However, the actual feeding speed of the to-be-transferred object may fluctuate due to the change of the diameter of the roller and the like caused by the eccentricity and thermal expansion of the feeding roller and the like to be different from the desired feeding speed. As a result, with the method of measuring the size (length) of the to-be-transferred object based on the measured time period and the feeding speed of the feeding roller, the size (length) of the to-be-transferred object may not be accurately measured.

SUMMARY OF THE INVENTION

The present invention is made in light of the above circumstances and may provide a to-be-transferred object length measurement device capable of measuring a length of a to-be-transferred object on which an image is transferred even when the diameter of the roller changes due to the eccentricity and thermal expansion of the feeding roller and the like, and an image forming apparatus and a computer program using such a to-be-transferred object length measurement device.

According to an aspect of the present invention, there is provide a to-be-transferred object length measurement device including a first rotating body feeding a to-be-transferred object; a passage detection unit disposed on a downstream side of the first rotating body and detecting a passage of the to-be-transferred object at a predetermined position in a to-be-transferred object feeding path; a rotation amount measurement unit measuring a rotation amount of the first rotating body in a first measurement period from when the passage detection unit starts detecting the passage of the to-be-transferred object at the predetermined position to a predetermined timing before the first rotating body completes feeding the to-be-transferred object; a second rotating body disposed on a downstream side of the first rotating body and the passage detection unit and feeding the to-be-transferred object after the first rotating body feeds the to-be-transferred object; a speed detection unit detecting a first feeding speed of the to-be-transferred object while the to-be-transferred object is fed by the first rotating body and further detecting a second feeding speed of the to-be-transferred object in a second measurement period from the predetermined timing to when the passage detection unit detects a completion of the passage of the to-be-transferred object at the predetermined position; and a calculation unit calculating a feeding distance of the to-be-transferred object per a predetermined rotation amount of the first rotating body based on the first feeding speed of the to-be-transferred object while the to-be-transferred object is fed by the first rotating body and further calculating a length of the to-be-transferred object based on the rotation amount of the first rotating body in the first measurement period, the feeding distance, and the second feeding speed of the to-be-transferred object in the second measurement period.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention are described with reference to the accompanying drawings.

First Embodiment

Figure 1:
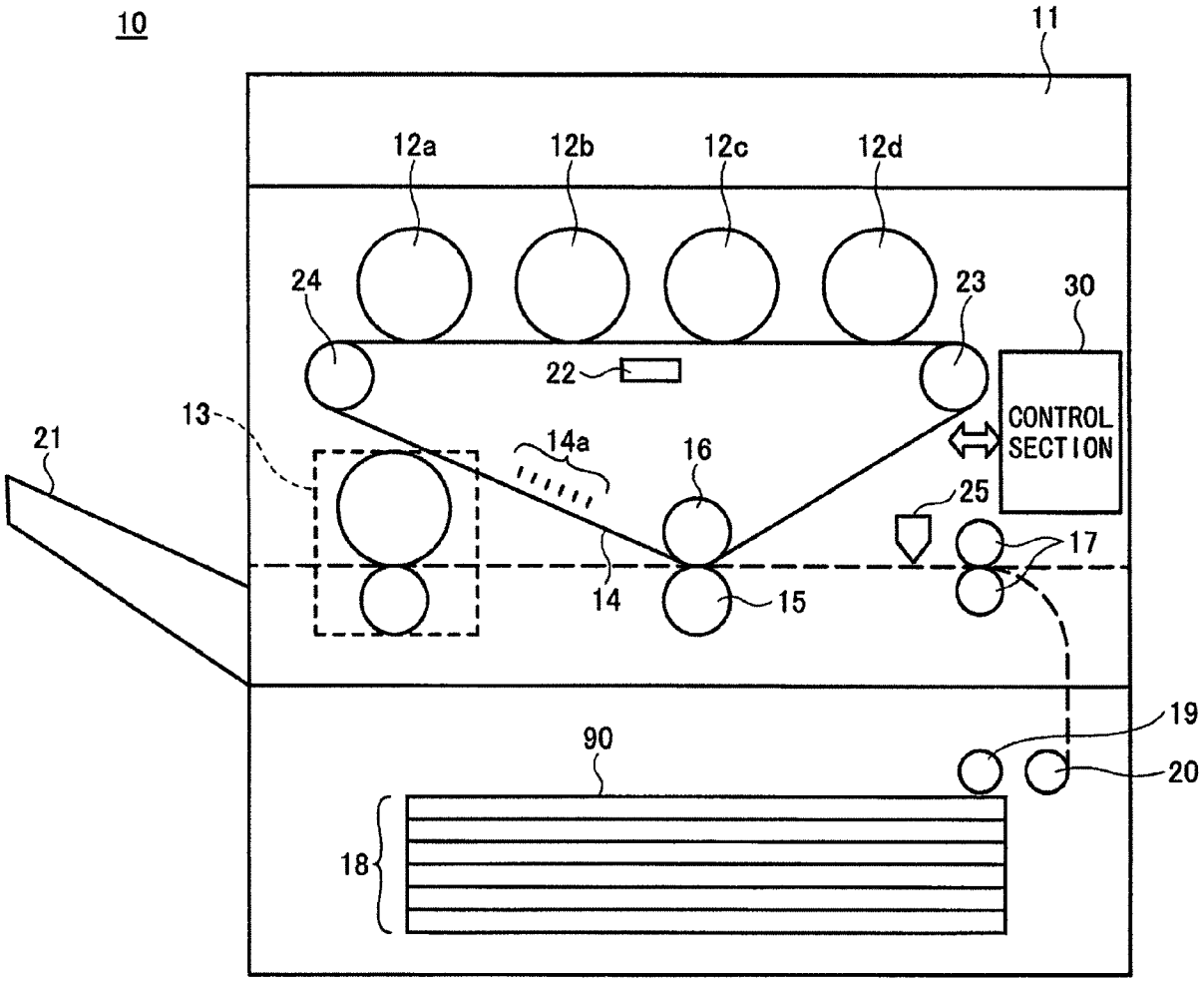
FIG. 1 is a schematic drawing showing an exemplary configuration of an image forming apparatus according to a first embodiment of the present invention.

A configuration of an image forming apparatus according to a first embodiment of the present invention FIG. 1 exemplarily shows a schematic configuration of an image forming apparatus 10 according to an embodiment of the present invention. As shown in FIG. 1, the image forming apparatus 10 is a color image forming apparatus using an intermediate transfer belt as an endless carrier body, the image forming apparatus 10 including a scanner unit 11, photoconductive drums 12*a* through 12*d*, a fixing unit 13, an intermediate transfer belt 14, a secondary transfer roller 15, a repulsive roller 16, feed rollers 17, a sheet supply unit 18, a sheet supply roller 19, a sheet feed roller 20, a sheet discharger unit 21, an intermediate transfer scale detection sensor 22, a drive roller 23, a follower roller 24, a passage detection unit 25, and a control section 30. Further, a numerical reference 90 represents a to-be-transferred object such as a transfer sheet.

The scanner unit 11 is configured to read a draft. The photoconductive drums 12*a* through 12*d* are configured to form respective yellow (Y), cyan (C), magenta (M), and black (K) images when the respective laser lights are irradiated. The fixing unit 13 is configured to fix the transferred toner image onto the to-be-transferred object 90.

The drive roller 23 is driven to be rotated by an intermediate transfer belt drive motor (not shown), thereby conveying (rotating) the intermediate transfer belt 14. The follower roller 24 rotates following the rotation of the drive roller 23. The intermediate transfer belt 14 is configured to superpose the colored images formed on the respective photoconductive drums 12*a* through 12*d*. The secondary transfer roller 15 is configured to transfer the image on the intermediate transfer belt 14 onto the to-be-transferred object 90.

The repulsive roller 16 faces the secondary transfer roller 15, and is configured to generate and maintain a nip between the intermediate transfer belt 14 and the secondary transfer roller 15. The feed rollers 17 are configured to, for example, correct a skew of and feed the to-be-transferred object 90. The sheet supply unit 18 is configured to stack the to-be-transferred objects 90. The sheet supply roller 19 is configured to discharge the to-be-transferred object 90 from the sheet supply unit 18 to the sheet feed roller 20. The sheet feed roller 20 is configured to feed the to-be-transferred object 90 discharged by the sheet supply roller 19 to the feed rollers 17. The sheet discharger unit 21 is configured to discharge the to-be-transferred object 90 on which an image has been transferred and fixed.

On the intermediate transfer belt 14, formed is an intermediate transfer belt scale 14*a*. Further, the intermediate transfer scale detection sensor 22 is disposed at a position near the intermediate transfer belt 14 where the intermediate transfer belt scale 14*a* can be read. Further, the passage detection unit 25 is disposed at a position in the feeding path of the to-be-transferred object 90.

The control section 30 is configured to perform various control (functions) on the image forming apparatus 10. The control section 30 includes, for example, a CPU, a ROM, a main memory and the like. The various functions of the control section 30 may be achieved by loading a control program stored in the ROM or the like to the main memory, and executing the control program by the CPU. However, a part or all of the control section 30 may be implemented only by hardware. Otherwise, the control section 30 may be physically divided into plural devices. Details of the functions of the control section 30 are described below.

Operations of an Image Forming Apparatus According to The First Embodiment of the Present Invention.

Figure 2:
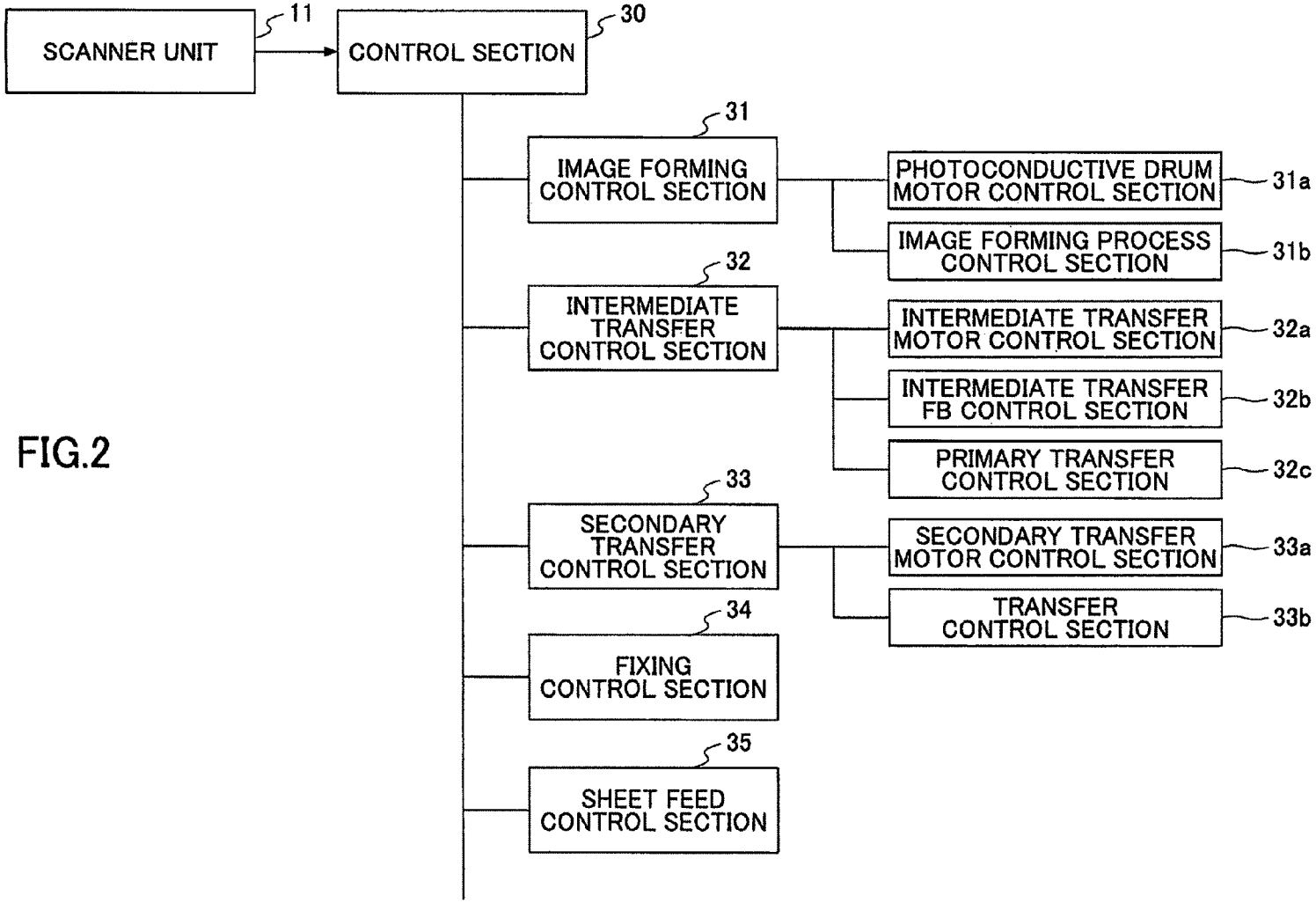
FIG. 2 is a functional block diagram showing functional components of a control section of the image forming apparatus of FIG. 1.

An image read by the scanner unit 11 of the image forming apparatus 10 shown in FIG. 1 is supplied to the control section 30. FIG. 2 is a functional block diagram showing exemplary functions of the control section 30. In FIG. 2, the same reference numerals are used for the same or similar components in FIG. 1, and the descriptions thereof may be omitted. As shown in FIG. 2, the control section 30 includes an image forming control section 31, an intermediate transfer control section 32, a secondary transfer control section 33, a fixing control section 34, and a sheet feed control section 35.

The image forming control section 31 is configured to control mainly the drive of the photoconductive drums 12*a* through 12*d*. The image forming control section 31 includes a photoconductive drum motor control section 31*a* and an image forming process control section 31*b*. The photoconductive drum motor control section 31*a* controls photoconductive drum motors (not shown) configured to drive the respective photoconductive drums 12*a* through 12*d*. The image forming process control section 31*b* controls electrophotographic processes including charging, exposing, and transferring processes.

The intermediate transfer control section 32 controls an intermediate transfer process. The intermediate transfer control section 32 includes an intermediate transfer motor control section 32*a*, an intermediate transfer FB control section 32*b*, and a primary transfer control section 32*c*. The intermediate transfer motor control section 32*a* controls an intermediate transfer motor (not shown) to drive the intermediate transfer belt 14. The intermediate transfer FB control section 32*b* performs feedback control of the speed of the intermediate transfer belt 14. Further, for example, the primary transfer control section 32*c* controls a process of transferring the toner images on the photoconductive drums 12*a* through 12*d* onto the intermediate transfer belt 14.

The secondary transfer control section 33 controls a secondary transfer process. The secondary transfer control section 33 includes a secondary transfer motor control section 33*a* and a transfer control section 33*b*. The secondary transfer motor control section 33*a* controls a secondary transfer motor (not shown) to drive the secondary transfer roller 15. Further, the transfer control section 33*b* controls, for example, a process of transferring the toner images on the intermediate transfer belt 14 onto the to-be-transferred object 90.

The fixing control section 34 controls a fixing function to fix the toner image on the to-be-transferred object 90, the toner image having been transferred onto the to-be-transferred object 90. Further, the sheet feed control section 35 controls, for example, a sequence of processes such as supplying, feeding, and discharging the to-be-transferred object 90.

In the image forming apparatus 10, an image read by the scanner unit 11 is supplied to the control section 30. Based on the supplied image, the control section 30 generates data of the image (hereinafter referred to as image data) to be formed on the to-be-transferred object 90. Based on the generated image data, the images are formed on the photoconductive drums 12*a* through 12*d* by the image forming control section 31. Then, the superposed image is formed on the intermediate transfer belt 14 by the intermediate transfer control section 32. Further, the image formed on the intermediate transfer belt 14 is transferred onto the to-be-transferred object 90 at the timing when the to-be-transferred object 90 is interposed between the intermediate transfer belt 14 and the secondary transfer roller 15 from the sheet supply unit 18.

During this process, in order to form an accurate image on the to-be-transferred object 90, the photoconductive drum motors (not shown) to drive the respective photoconductive drums 12*a* through 12*d* are controlled by the photoconductive drum motor control section 31*a*; the intermediate transfer motor (not shown) to drive the intermediate transfer belt 14 is controlled by the intermediate transfer motor control section 32*a*; and the secondary transfer motor (not shown) to drive the secondary transfer roller 15 is controlled by the secondary transfer motor control section 33*a*.

The image transferred onto the to-be-transferred object 90 passes through the fixing unit 13. During this passage, the fixing control section 34 controls a fixing function to fix the toner image on the to-be-transferred object 90, the toner image having been transferred onto the to-be-transferred object 90. As a result, the toner image on the to-be-transferred object 90 is fixed. After that, the to-be-transferred object 90 is discharged to the sheet discharger unit 21 by the sheet feed control section 35.

Measurement of the Length of the to-be-transferred Object

In the following, a method capable of accurately measuring the length of the to-be-transferred object 90 is described. To accurately measure the size (length) of the to-be-transferred object 90 may be very important. For example, in a case where the above-mentioned typical operations are performed, provided that the size (length) of the to-be-transferred object 90 shrinks and that the image is formed on the to-be-transferred object 90 without changing (adjusting) the size (length) of the image to be formed on the to-be-transferred object 90, the size (length) of the image formed on the to-be-transferred object 90 may be greater than that of the image to be desirably (originally) formed. Therefore, in this case, it may be required to reduce the size (length) of the image to be formed in accordance with the shrinkage of the to-be-transferred object 90.

Figure 3:
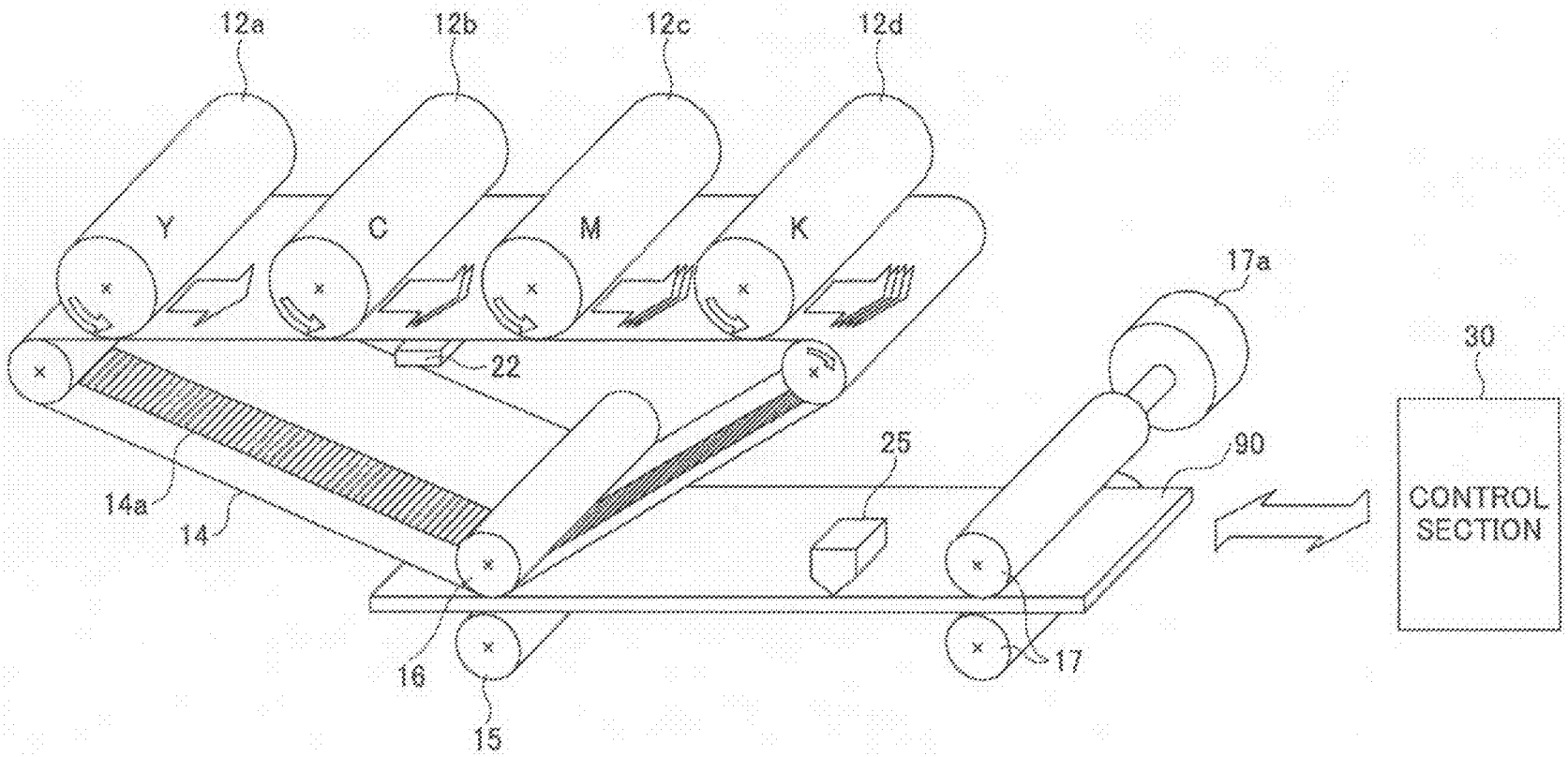
FIG. 3 is an enlarged drawing showing the vicinity of an intermediate transfer belt of FIG. 1.

FIG. 3 is an enlarged drawing showing the vicinity of an intermediate transfer belt shown in FIG. 1. In FIG. 3, the same reference numerals are used for the same or similar components in FIG. 1, and the descriptions thereof may be omitted. As shown in FIG. 3, the feed roller 17 is equipped with an encoder 17*a*. The encoder 17*a* is a sensor capable of converting a mechanical displacement amount in the rotating direction into a digital amount, and is configured to output a pulse signal in accordance with the rotation amount of the feed roller 17. The encoder 17*a* may be a representative example of a pulse signal output unit of the present invention. Further, the encoder 17*a* may be a representative component of a rotation angle measurement unit of the present invention. The control section 30 may measure the rotation amount of the feed roller 17 by counting the number of pulses output from the encoder 17*a*. Therefore, the encoder 17*a* and the control section 30 may be representative components of a rotation amount measurement unit of the present invention.

As the encoder 17*a*, a known encoder may be used. As an example of the encoder 17*a*, there are a photoelectric sensor used by irradiating light onto a slit disk on which scales are formed and detecting an optical pulse passed through the slit as the positional information of the rotation, a magnetic sensor by using a rotating disk or drive on which a magnetic pattern is formed and detecting the cyclically changing magnetic field as positional information of the rotation, a capacitance sensor detecting the change of capacitance, and a continuity sensor detecting the electrical continuity. Further, the feed roller 17 may be a representative example of a first rotating body of the present invention.

The intermediate transfer belt 14 is equipped with an intermediate belt scale 14*a*. The intermediate belt scale 14*a* includes indications, more specifically, reflection parts and non-reflecting parts alternately disposed at predetermined intervals along the feeding direction. Further, the intermediate transfer scale detection sensor 22 is disposed at a position near the intermediate transfer belt 14 where the intermediate transfer belt scale 14*a* can be read. Further, the intermediate transfer scale detection sensor 22 is configured to output a pulse signal corresponding to a predetermined cycle of the intermediate transfer belt scale 14*a* formed on the intermediate transfer belt 14.

The intermediate transfer scale detection sensor 22 includes, for example, a light-emitting device, a light-receiving device, and a pulse generation section (not shown). In this case, the light-emitting section emits light onto the intermediate transfer belt scale 14*a*; the light-receiving device receives light reflected from the intermediate transfer belt scale 14*a* and generates an electric signal in accordance with the amount of the received (reflected) light; and the pulse generation section generates a pulse signal based on the electric signal generated by the light-receiving device. Further, the intermediate transfer belt 14 may be a representative example of a second rotating body of the present invention.

The control section 30 is capable of measuring a feeding speed of the intermediate transfer belt 14 (=a rotating speed of the secondary transfer roller 15) by counting the pulses of the pulse signal output from the intermediate transfer scale detection sensor 22. While the to-be-transferred object 90 is being passed between the intermediate transfer belt 14 and the secondary transfer roller 15, a feeding speed of the intermediate transfer belt 14 (=a rotating speed of the secondary transfer roller 15) is equal to a feeding speed of the to-be-transferred object 90. Further, the intermediate transfer belt 14, the intermediate transfer belt scale 14*a*, and the intermediate transfer scale detection sensor 22 may be representative components of a speed detection unit of the present invention.

The passage detection unit 25 is provided in the feeding path of the to-be-transferred object 90, and is configured to detect the passage of the to-be-transferred object 90. The passage detection unit 25 includes, for example, a light-emitting device and a light-receiving device (not shown). In this case, the light-emitting section emits light onto the to-be-transferred object 90; and the light-receiving device receives light reflected from the to-be-transferred object 90 and generates an electric signal in accordance with the amount of the received (reflected) light. Then, it may become possible to determine whether the to-be-transferred object 90 is being passed through depending on an amplitude of the generated electric signal.

As described in detail below, the control section 30 is configured to calculate the length of the to-be-transferred object 90. Therefore, the control section 30 may be a representative example of a calculation unit of the present invention.

Further, the intermediate transfer belt 14, the intermediate transfer belt scale 14*a*, the secondary transfer roller 15, the repulsive roller 16, the feed rollers 17, the encoder 17*a*, the intermediate transfer scale detection sensor 22, the passage detection unit 25, and the control section 30 may be representative components of a to-be-transferred object length measurement device of the present invention.

FIGS. 4A through 4E sequentially show how the to-be-transferred object is conveyed (fed) in the image forming apparatus according to the first embodiment of the present invention. In FIGS. 4A through 4E, the same reference numerals are used for the same or similar components in FIG.

Figure 4A:
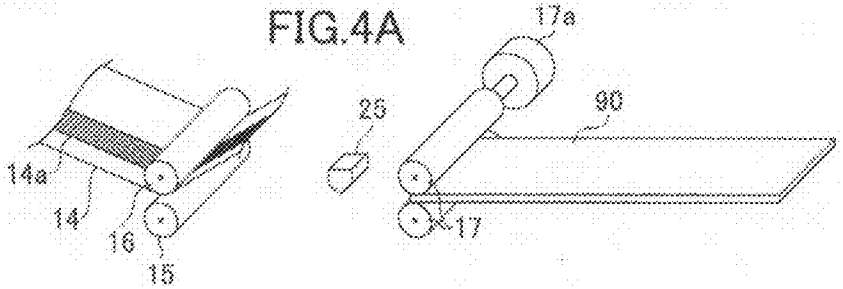
FIGS. 4A through 4E sequentially show how a to-be-transferred object is conveyed.
Figure 4B:
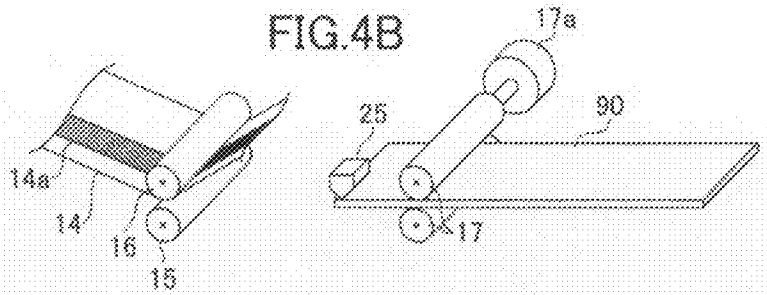

1, and the descriptions thereof may be omitted. With reference to FIGS. 4A through 4E, how the to-be-transferred object is conveyed is described. First, as shown in FIG. 4A, the to-be-transferred object 90 is interposed between the feed rollers 17 (i.e., the first rotating body), and the feed rollers 17 are started to feed the to-be-transferred object 90. Next, as shown in FIG. 4B, the passage detection unit 25 detects the beginning of the passage of the to-be-transferred object 90. In the status of FIG. 4B, the feed rollers 17 are feeding the be-transferred object 90 similar to the case of FIG. 1.

Figure 4C:
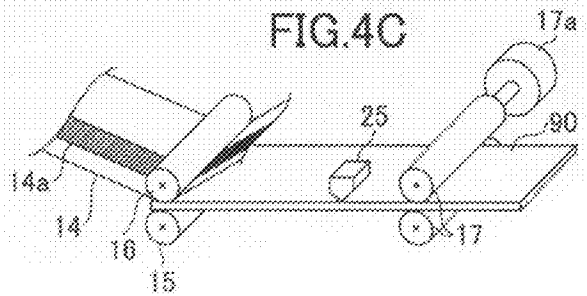

Next, as shown in FIG. 4C, the to-be-transferred object 90 is interposed between the intermediate transfer belt 14 and the secondary transfer roller 15, so that the to-be-transferred object 90 is fed by both the intermediate transfer belt 14 and the feed rollers 17. In this case, it is to be adjusted so that the feeding speed (hereinafter may be simplified as speed) of the intermediate transfer belt 14 is to be equal to that of the feed rollers 17 (This speed is abbreviated and given as "VA"). For example, by setting the speed of the intermediate transfer belt 14 being slightly faster than that of the feed rollers 17, the feed rollers 17 follow the intermediate transfer belt 14. By setting in this way, it may become possible to adjust so that the speed of the intermediate transfer belt 14 is to be equal to that of the feed rollers 17. Otherwise, the feeding speed or a feeding torque of the intermediate transfer belt 14 and the feed rollers 17 may be controlled so that the to-be-transferred object 90 is not compressed nor extended. By controlling in this way, it may also become possible to adjust so that the feeding speed of the intermediate transfer belt 14 is to be equal to that of the feed rollers 17.

Figure 4D:
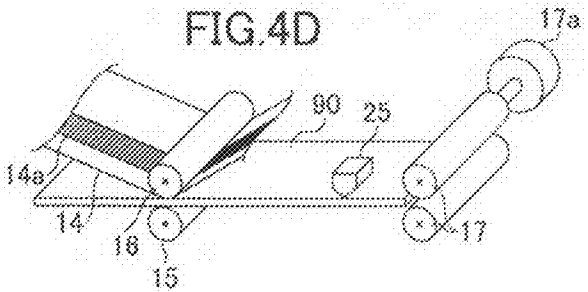

Next, as shown in FIG. 4D, the to-be-transferred object 90 has passed between (is separated from) the feed rollers 17, so that the to-be-transferred object 90 is fed only by the intermediate transfer belt 14 (This speed in this case is abbreviated and given as "VB"). The speed VB may not be equal to the speed VA. For example, it is assumed that the speed VB (when the to-be-transferred object 90 is fed only by the intermediate transfer belt 14) is faster than the speed when the to-be-transferred object 90 is fed by only the feed rollers 17. In this case, when the to-be-transferred object 90 is fed by both the intermediate transfer belt 14 and the feed rollers 17 (i.e., when the feed rollers 17 follows the intermediate transfer belt 14), since the slower speed of the feed rollers 17 may act as a load to reduce the faster speed of the intermediate transfer belt 14, the speed VA may become slower than the speed VB (VA<VB).

Figure 4E:
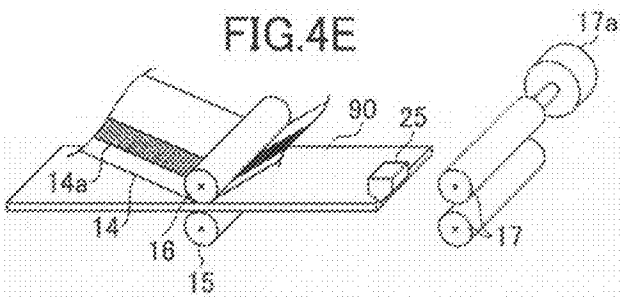

Next, as shown in FIG. 4E, the passage detection unit 25 detects that the to-be-transferred object 90 has passed through a point where the passage detection unit 25 detects the to-be-transferred object 90. In this case, similar to the case of FIG. 4D, the to-be-transferred object 90 is fed only by the intermediate transfer belt 14.

Figure 5:
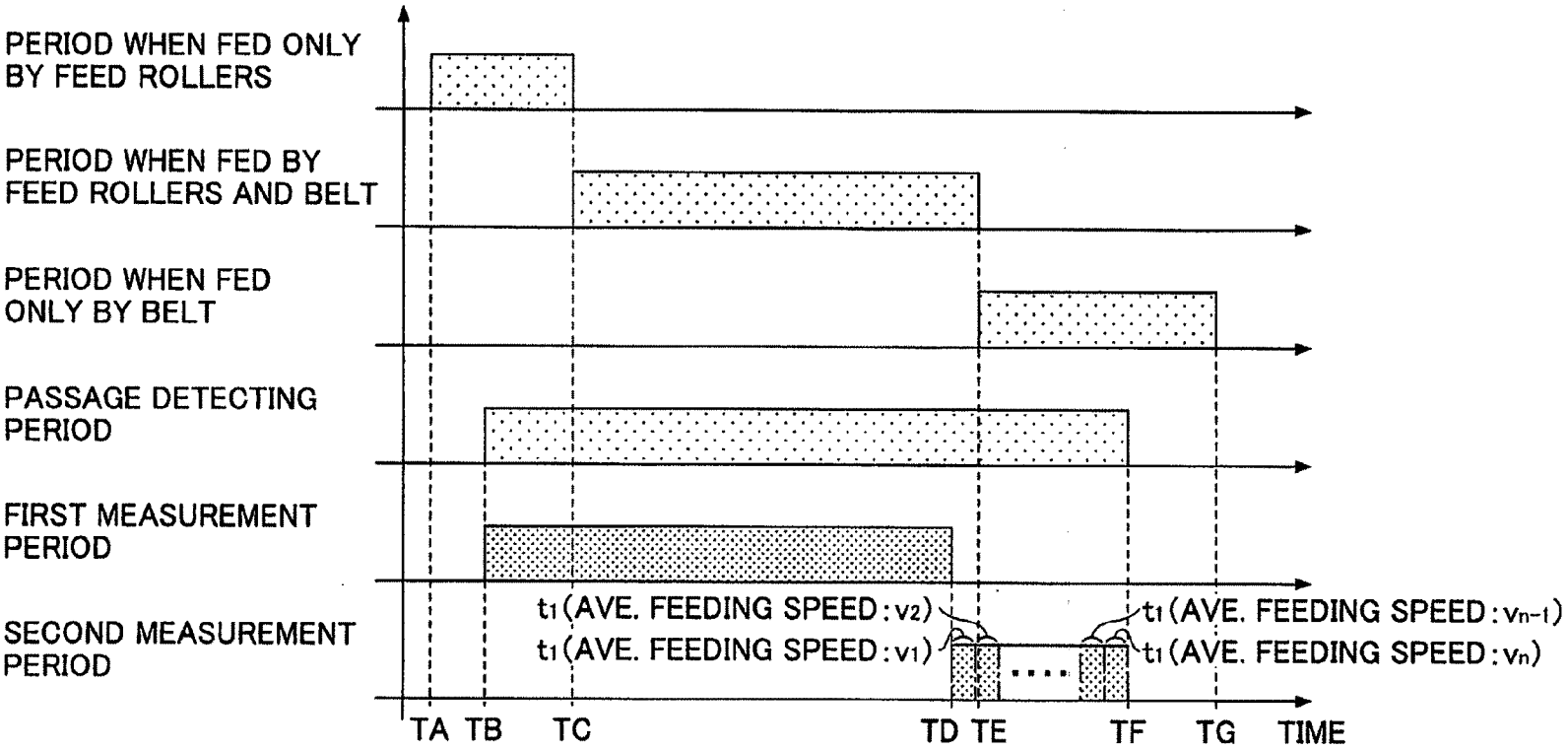
FIG. 5 a timing chart illustrating an example of the operations when the to-be-transferred object is conveyed.

Next, with reference to FIG. 5, a method of obtaining the length of the to-be-transferred object 90 is described. FIG. 5 shows an example of a timing chart in a case where the to-be-transferred object 90 is being conveyed. In FIG. 5, in a time period from time TA to time TC, the to-be-transferred object 90 is fed only by the feed rollers 17. In a time period from time TC to time TE, the to-be-transferred object 90 is fed by both the intermediate transfer belt 14 and the feed rollers 17. In a time period from time TE to time TG, the to-be-transferred object 90 is fed only by the intermediate transfer belt 14. Further, during a time period from time TB to time TF, the passage detection unit 25 detects the passage of the to-be-transferred object 90.

In this embodiment of the present invention, a time period from time TB to time TF (i.e., a time period while the passage detection unit 25 detects the passage of the to-be-transferred object 90) is divided into two periods: a first measurement period and a second measurement period. The first measurement period is defined as a time period from time TB to time TD, that is a time period from a timing when the passage detection unit 25 starts detecting the passage of the to-be-transferred object 90 to a predetermined timing before the feed rollers 17 finishes feeding the to-be-transferred object 90. The second measurement period is defined as a time period from time TD to time TF, that is a time period from the predetermined timing before the feed rollers 17 finishes feeding the to-be-transferred object 90 to when the passage detection unit 25 detects the completion of the passage of the to-be-transferred object 90. Then, the feeding distances of the first measurement period and the second measurement period are separately calculated using different methods, and the length of the to-be-transferred object 90 is obtained by summing the results (feeding distances) of the first measurement period and the second measurement period.

In the first measurement period, a feeding distance (first feeding distance) of the to-be-transferred object 90 in the first measurement period may be calculated based on the following formula (1).

The first feeding distance of the to-be-transferred object 90=(one-pulse feeding distance "a")×(pulse count No. "*b*") formula (1)

Herein, the one-pulse feeding distance "a" refers to a feeding distance of the to-be-transferred object 90 per one pulse of the encoder 17*a* [mm/pulse]. Further, the pulse count No. "b" refers to the counted number of the pulses of the pulse signal output from the encoder 17*a* during the first measurement period.

When assuming that the radius "r" of the feed roller 17 does not fluctuate with time, the one-pulse feeding distance "a" may be calculated based on a formula: 2πr/(the number of pulses of one rotation of the encoder). However, practically, the radius "r" of the feed roller 17 may fluctuate due to thermal expansion of the feed roller 17 or the like; therefore, it may not be feasible to accurately calculate the one-pulse feeding distance "a" using the radius "r" of the feed roller 17. To overcome the circumstance, in this embodiment of the present invention, in the time period from time TC to time TE (i.e., the time period while the to-be-transferred object 90 is being fed by both the intermediate transfer belt 14 and the feed rollers 17), the one-pulse feeding distance "a" is calculated based on the following formula (2).

one-pulse feeding distance "*a*"=(averaged feeding distance in a predetermined time period "*t*" (i.e., averaged feeding speed of the intermediate transfer belt 14×*t*))/pulse count No. of the encoder 17*a* during the predetermined time period "*t*" formula (2)

In formula (2), the one-pulse feeding distance "a" is calculated based on the averaged feeding speed of the intermediate transfer belt 14. Because of this feature, it may become possible to accurately calculate the one-pulse feeding distance "a" even when the radius "r" of the feed roller 17 fluctuates.

In the second measurement period, a feeding distance (second feeding distance) of the to-be-transferred object 90 in the second measurement period is calculated based on the averaged feeding speed of the intermediate transfer belt 14. More specifically, an averaged feeding speed "$v_n$" (herein n: a natural number) of the intermediate transfer belt 14 per unit time "$t_1$" is measured, and then, a feeding distance "$c_n$" of the to-be-transferred object 90 per unit time "$t_1$" is calculated by $c_n=t_1\times v_n$. Namely, first, in the first time period "$t_1$" from time TD, the averaged feeding speed "$v_1$" of the intermediate transfer belt 14 per unit time "$t_1$" is measured, and then, based on the measured averaged feeding speed "$v_1$", the feeding distance $c_1$ of the to-be-transferred object 90 per unit time "$t_1$" is calculated by $c_1=t_1\times v_1$. Next, similarly, in the second (next) time period "$t_1$", the averaged feeding speed "$v_2$" of the intermediate transfer belt 14 per unit time "$t_1$" is measured, and then, based on the measured the averaged feeding speed "$v_2$", the feeding distance "$c_2$" of the to-be-transferred object 90 per unit time "$t_1$" is calculated by $c_2=t_1\times v_2$. This process is repeated until the passage detection unit 25 detects the completion of the passage of the to-be-transferred object 90. When "n" multiples of the time period "$t_1$" are included until the passage detection unit 25 detects the completion of the passage of the to-be-transferred object 90 (i.e, the second measurement period is given as $n\times t_1$), n feeding distances (i.e., $c_1$ through $c_n$) are calculated. Based on the calculated n feeding distances (i.e., $c_1$ through $c_n$), the second feeding distance of the to-be-transferred object 90 in the second measurement period is calculated by the following formula (3).

The second feeding distance of the to-be-transferred object 90 $c=c_1+c_2+\ldots+c_n$ formula (3)

Any appropriate time period may be used as the unit time "$t_1$". Herein, however, it is assumed the value of the unit time "$t_1$" is a sufficiently small value when compared with the value of the second measurement period.

The length of the to-be-transferred object 90 is calculated by summing the first measurement period and the second measurement period together. Namely, based on the formulas (1) and (3), the length of the to-be-transferred object 90 is given by the following formula (4).

Length of the to-be-transferred object 90=(one-pulse feeding distance "*a*")×(pulse count No. "*b*")+(second feeding distance of the to-be-transferred object 90"*c*") formula (4)

Figure 6:
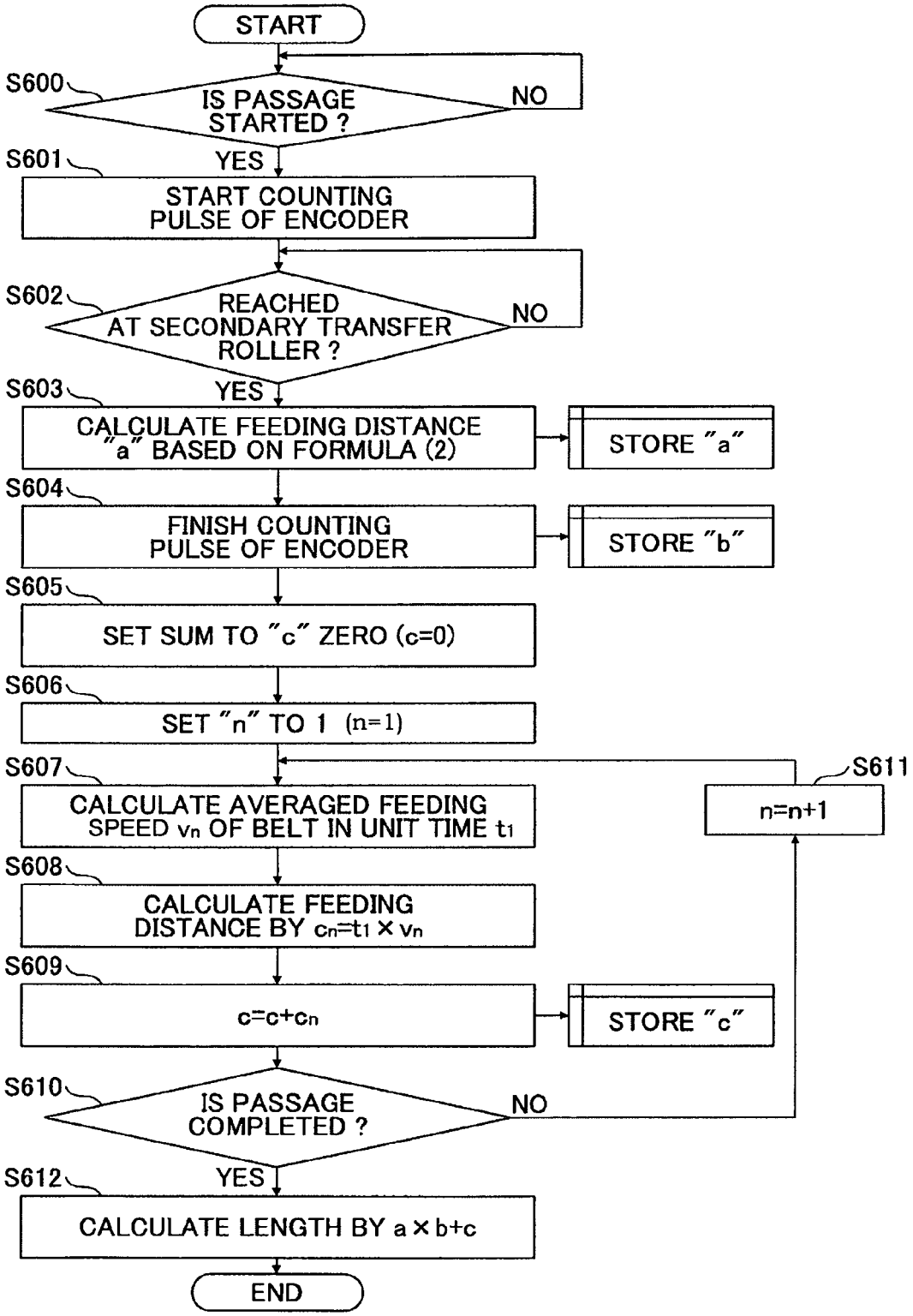
FIG. 6 is a flowchart showing a process of measuring a length of the to-be-transferred object according to the first embodiment of the present invention.

Next, with reference to FIG. 6, more detail of the method of obtaining the length of the to-be-transferred object 90 is described. FIG. 6 is a flowchart showing a process of measuring the length of the to-be-transferred object according to this embodiment of the present invention. First, in step S600, the control section 30 determines whether the passage detection unit 25 detects the beginning of the passage of the to-be-transferred object 90 based on the output from the passage detection unit 25 (step S600). When determining that the start of the passage of the to-be-transferred object 90 is not detected in step S600 (NO in step S600), the process goes back to the same step S600 to execute step S600 again. On the other hand, when determining the beginning of the passage of the to-be-transferred object 90 is detected in step S600 (YES in step S600), the process goes to step S601. In step S601, the control section 30 starts counting the number of pulses of the pulse signal from the encoder 17*a* (step S601). The first measurement period starts from this step S601.

Next, in step S602, the control section 30 determines whether the to-be-transferred object 90 is interposed between the intermediate transfer belt 14 and the secondary transfer roller 15 (step S602). For example, whether the to-be-transferred object 90 is interposed between the intermediate transfer belt 14 and the secondary transfer roller 15 may be determined based on a determination whether a predetermined time period has passed since the passage detection unit 25 detects the beginning of the passage of the to-be-transferred object 90. In this case, it may be assumed that an approximate length and an approximate feeding speed of the to-be-transferred object 90 are given. Therefore, based on the approximate length and the approximate feeding speed of the to-be-transferred object 90, it may become possible to calculate the predetermined time period from when the passage detection unit 25 detects the beginning of the passage of the to-be-transferred object 90 to when the to-be-transferred object 90 is interposed between the intermediate transfer belt 14 and the secondary transfer roller 15. In this case, preferably, the predetermined time period is determined in a manner such that the to-be-transferred object 90 never fails to be interposed between the intermediate transfer belt 14 and the secondary transfer roller 15 after the predetermined time period has passed since the passage detection unit 25 has detected the beginning of the passage of the to-be-transferred object 90.

Further, as another example, whether the to-be-transferred object 90 is interposed between the intermediate transfer belt 14 and the secondary transfer roller 15 may be determined by monitoring a value of a shock jitter (i.e., speed fluctuation) which is to be changed upon the interposition of the to-be-transferred object 90 between the intermediate transfer belt 14 and the secondary transfer roller 15. In this case, during monitoring the value of the shock jitter, when the value of the shock jitter exceeds a predetermined threshold value, it may become possible to determine that the to-be-transferred object 90 is interposed between the intermediate transfer belt 14 and the secondary transfer roller 15.

In step S602, when determining that the interposition of the to-be-transferred object 90 between the intermediate transfer belt 14 and the secondary transfer roller 15 is not detected (NO in step S602), the process goes back to the same step S602 to execute step S602 again. On the other hand, when determining that the interposition of the to-be-transferred object 90 between the intermediate transfer belt 14 and the secondary transfer roller 15 is detected (YES in step S602; in this case, the to-be-transferred object 90 is fed by both the intermediate transfer belt 14 and the secondary transfer roller 15), the process goes to step S603. In step S603, the control section 30 calculates the one-pulse feeding distance "a" using formula (2), and stores the calculated value of the one-pulse feeding distance "a".

Next, in step S604, at a predetermined timing before the timing when the feed rollers 17 finishes feeding the to-be-transferred object 90 (i.e., at a predetermined timing before the timing when the tail end of the to-be-transferred object 90 is separated from the feed rollers 17), the control section 30 stops counting the number of pulses of the pulse signal from the encoder 17*a*, and stores the counted number of the pulses as the pulse count No. "b" (step S604). In this case, at the predetermined timing, the first measurement period is terminated and the second measurement period is started. In this case, as the predetermined timing, any appropriate timing may be set (selected) as long as the timing is the timing after the value of the one-pulse feeding distance "a" is calculated; however, preferably, the predetermined timing is the timing just before the timing when the to-be-transferred object 90 is separated from the feed rollers 17. By determining the predetermined timing in this way, it may become possible to perform sufficient averaging operations on the value of the one-pulse feeding distance "a". By sufficiently averaging the value of the one-pulse feeding distance "a", it may become possible to effectively reduce the influences of the eccentricity and the partial thermal expansion of the feed rollers 17 when the influences occur. Further, for example, the predetermined timing may be determined as the timing after a certain time period has passed since the passage detection unit 25 has detected the beginning of the passage of the to-be-transferred object 90. This is because, as described above, the approximate length and the approximate feeding speed of the to-be-transferred object 90 are given. Therefore, based on the approximate length and the approximate feeding speed of the to-be-transferred object 90, it may become possible to determine the certain time period; thereby enabling determining the predetermined time period.

Next, in step S605, the control section 30 sets a sum "c" of the feeding distances to be zero (c=0) (step S605). Next, in step S606, the control section 30 sets "n" to be one (n=1) (step S606). Next, in step S607, the control section 30 calculates the averaged feeding speed "$v_n$" of the intermediate transfer belt 14 in the unit time "$t_1$" (step S607). Next, in step S608, the control section 30 calculates the feeding distance "$c_n$" of the to-be-transferred object 90 per unit time "$t_1$" based on the following formula: feeding distance $c_d$=(unit time $t_1$)×(averaged feeding speed $v_n$) (step S608).

Next, in step S609, the control section 30 adds the feeding distance "$c_n$" calculated in step S608 to the sum "c" of the feeding distances ($c=c+c_n$), and stores the sum "c" of the feeding distances after the calculation in this step (steps S609). In step S609, whenever the feeding distance "$c_n$" is added to the sum "c" of the feeding distances, the latest (new) value of the sum "c" of the feeding distances is stored.

Next, in step S610, based on the output from the passage detection unit 25, the control section 30 determines whether the passage detection unit 25 has detected the completion of the passage of the to-be-transferred object 90 (i.e., whether the passage detection unit 25 has detected that the tail end of the to-be-transferred object 90 has passed through a point where the passage detection unit 25 detects the to-be-transferred object 90) (step S610). In step S610, when determining that the completion of the passage of the to-be-transferred object 90 has not been detected (NO in step S610), the process goes to step S611. In step S611, the control section 30 increments n to be n+1 (n=n+1). After that, the process goes back to step S607 to execute steps S607 through S610. In step S610, when determining that the completion of the passage of the to-be-transferred object 90 is detected (YES in step S610), the process goes to step S612 to execute step S612. When the completion of the passage of the to-be-transferred object 90 is detected, the second measurement period is terminated.

Next, in step S612, the control section 30 calculates the length of the to-be-transferred object 90 based on the formula (4) using the one-pulse feeding distance "a" stored in step S603, the pulse count No. "b" stored in step S604, and the sum "c" of the feeding distances stored in step S609 (steps S612).

As described above, it may become possible to calculate the length of the to-be-transferred object 90 by adding the first feeding distance of the to-be-transferred object 90 in the first measurement period (i.e., one-pulse feeding distance "a"× pulse count No. "b") to the second feeding distance of the to-be-transferred object 90 in the second measurement period (i.e., sum "c" of the feeding distances).

Further, the process exemplarily shown in FIG. 6 may be stored in a ROM or the like as a control program including steps capable of executing the process exemplarily shown in FIG. 6. The control program stored in the ROM or the like may be executed by a CPU. Further, a part or all of the process may be achieved only by hardware.

As described above, according to the first embodiment of the present invention, the time period while the passage detection unit 25 is detecting the passage of the to-be-transferred object 90 is divided into two periods: a first measurement period and a second measurement period. In this case, the first measurement period is defined as a time period from when the passage detection unit 25 starts detecting the passage of the to-be-transferred object 90 to the predetermined timing before the feed rollers 17 finishes feeding the to-be-transferred object 90. The second measurement period is defined as the time period from the predetermined timing before the feed rollers 17 finishes feeding the to-be-transferred object 90 to when the passage detection unit 25 detects the completion of the passage of the to-be-transferred object 90. Further, in the first measurement period, the first feeding distance of the to-be-transferred object 90 in the first measurement period is calculated by multiplying the one-pulse feeding distance "a" by the pulse count No. "b" of the encoder 17*a*. In the second measurement period, the second feeding distance of the to-be-transferred object 90 in the second measurement period is calculated based on the averaged feeding speed of the intermediate transfer belt 14 in the unit time. After that, by adding the first feeding distance to the second feeding distance, the length of the to-be-transferred object 90 may be calculated. In this case, the calculation is based on the averaged feeding speed of the intermediate transfer belt 14 and the number of pulses of the pulse signal from the encoder 17*a* in the period when the to-be-transferred object 90 is fed by both the intermediate transfer belt 14 and the secondary transfer roller 15 without using the radius "r" of the feed roller 17. Because of this feature, it may become possible to accurately calculate the one-pulse feeding distance "a" even when the radius "r" of the feed roller 17 fluctuates. As a result, it may become possible to accurately calculate the size (length) of the to-be-transferred object 90.

Second Embodiment

As described above, in the first embodiment of the present invention, the length of the to-be-transferred object 90 is calculated by adding the first feeding distance (i.e., one-pulse feeding distance "a"×pulse count No. "b") to the second feeding distance (i.e., sum "c" of the feeding distances). On the other hand, according to the second embodiment of the present invention, there is provided a correction count value "d". The correction count value "d" is counted up whenever a sum "c'" of the feeding distances is equal to or greater than the one-pulse feeding distance "a" obtained based on formula (2). In this case, the sum "c'" of the feeding distances is obtained by adding the feeding distances "$c_n$" per unit time "$t_1$" in the second measurement period. Then, the length of the to-be-transferred object 90 is obtained by multiplying a sum of the "pulse count No. "b"" and the "correction count value "d"" by the "one-pulse feeding distance "a"". In the following, a description of the same parts as those in the first embodiment may be omitted.

In this embodiment, similar to the first embodiment, the second feeding distance of the to-be-transferred object 90 in the second measurement period is calculated based on the averaged feeding speed of the intermediate transfer belt 14 in the unit time. The method of calculating the feeding distance "$c_n$" (n=0, 1, . . . , k) per unit time "$t_1$" is the same as that in the first embodiment. Therefore, the repeated description of this method is herein omitted.

In this embodiment, as described above, the correction count value "d" is counted up whenever the sum "c'" of the feeding distances is equal to or greater than the one-pulse feeding distance "a" obtained based on formula (2), the sum "c'" of the feeding distances being obtained by adding the feeding distances "$c_n$" per unit time "$t_1$".

The initial value of the correction count value "d" is zero (d=0). In a specific example, when assuming that the sum of the feeding distances $c_1$ through $c_9$ is equal to the one-pulse feeding distance "a", the correction count value "d" is counted up when all the feeding distances $c_1$ through $c_9$ are added to the sum "c'" of the feeding distances ($c'=c_1+\ldots+c_9$). By doing in this way, the number of one-pulse feeding distance "a" is counted by counting the correction count value "d" until the passage detection unit 25 detects the completion of the passage of the to-be-transferred object 90. Herein, as the unit time "$t_1$", any appropriate unit time may be used. However, preferably, the value of the unit time "$t_1$" is to be determined in a manner such that the feeding distance "$c_a$" is sufficiently small value when compared with the value of the one-pulse feeding distance "a".

The length of the to-be-transferred object 90 may be obtained by multiplying the sum of the pulse count No. "b" obtained in the first measurement period and the correction count value "d" obtained based on the feeding distance in the second measurement period by the one-pulse feeding distance "a" as in the following formula (5)

Length of the to-be-transferred object 90=(one-pulse feeding distance "*a*")×((pulse count No. "*b*")+(correction count value "*d*")) formula (5)

Figure 7:
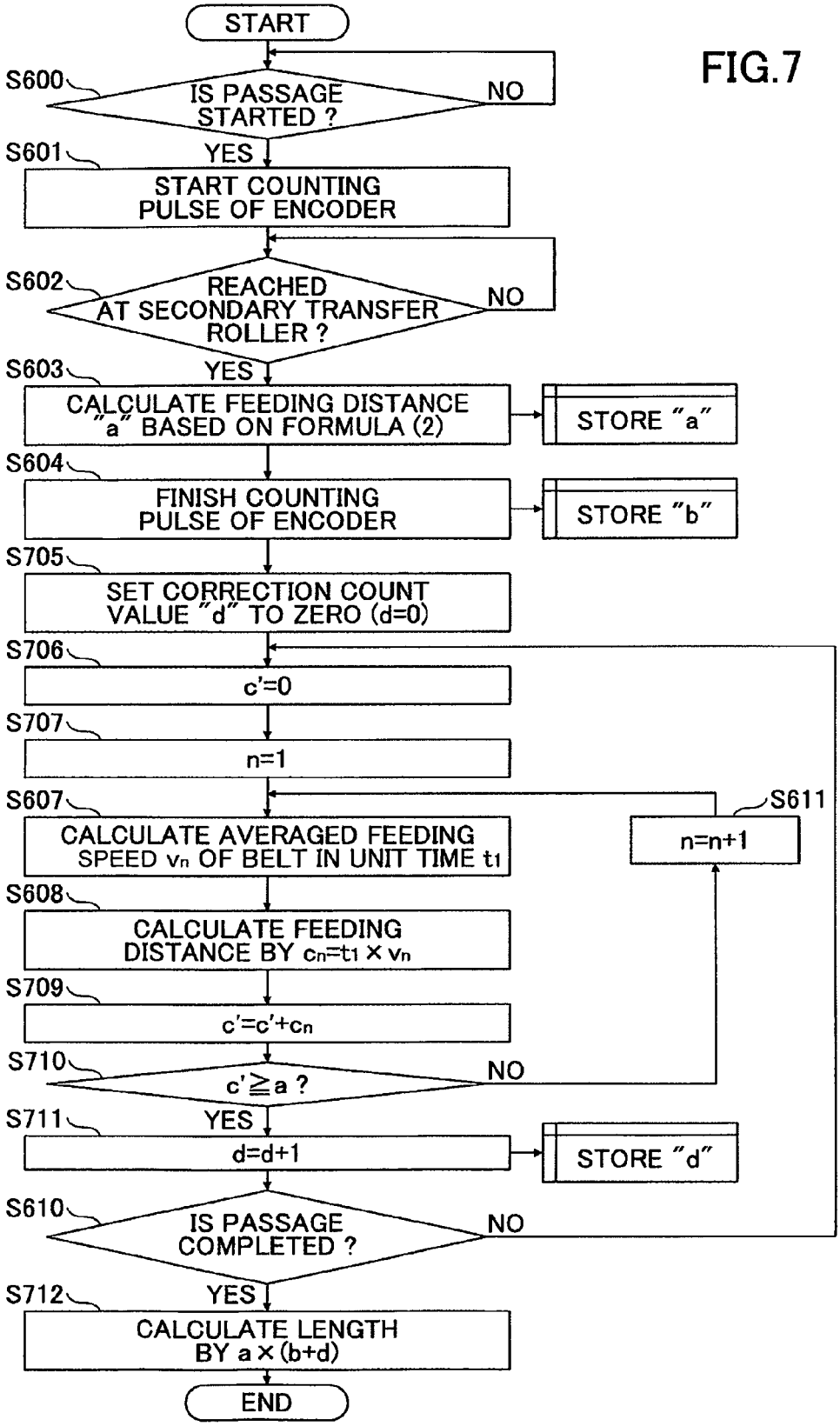
FIG. 7 is a flowchart showing a process of measuring the length of the to-be-transferred object according to a second embodiment of the present invention.

FIG. 7 is a flowchart showing another process of measuring the length of the to-be-transferred object according to the second embodiment of the present invention. In FIG. 7, the same reference numerals are used for the same steps in FIG. 6, and the descriptions thereof may be omitted.

First, the process of steps S600 through S604 is executed.

Next, in step S705, the control section 30 sets the correction count value "d" to be zero (d=0) (step S705). Next, in step S706, the control section 30 sets the sum "c'" of the feeding distances to be zero (c'=0) (step S706). Next, in step S707, the control section 30 sets "n" to be one (n=1) (step S707). Next, the process of steps S607 and 5608 is executed similar to the process of steps S607 and 5608 in FIG. 6.

Next, in step S709, the feeding distance "$c_n$" calculated in step S608 is added to the sum "c'" of the feeding distances (step S709). Next, in step S710, the control section 30 determines whether the sum "c'" of the feeding distances is equal to or greater than the one-pulse feeding distance "a" stored in step S603 (steps S710). In step S710, when determining that the sum "c'" of the feeding distances is not equal to nor greater than the one-pulse feeding distance "a" (NO in step S710), the process goes to step S611. In step S611, the control section 30 increments n to be n+1 (n=n+1). After that, the process goes back to step S607 to execute steps S607 through S709. In step S710, when determining that the sum "c'" of the feeding distances is equal to or greater than the one-pulse feeding distance "a" (YES in step S710), the process goes to step S711. In step S711, the control section 30 increments (counts up) the correction count value "d" by one (d=d+1), and then, the new value "d" is stored in a memory (step S711).

Next, in step S610, the process similar to that of step S610 in FIG. 6 is executed. In step S610, when determining that the completion of the passage of the to-be-transferred object 90 is not detected (NO in step S610), the process goes back to step S706 to execute the process of steps S706 through S711. In step S610, when determining that the completion of the passage of the to-be-transferred object 90 is detected (YES in step S610), the process goes to step S712 to execute the process of step S712. When the completion of the passage of the to-be-transferred object 90 is detected, the second measurement period is terminated.

Next, in step S712, the control section 30 calculates the length of the to-be-transferred object 90 based on the formula (5) using the one-pulse feeding distance "a" stored in step S603, the pulse count No. "b" stored in step S604, and the correction count value "d" stored in step S711 (steps S712).

As described above, it may become possible to calculate the length of the to-be-transferred object 90 by multiplying a sum of the "pulse count No. "b"" in the first measurement period and the correction count value "d" in the second measurement period by the one-pulse feeding distance "a", the correction count value "d" representing the number using one-pulse feeding distance "a" as a reference (unit).

Further, the process exemplarily shown in FIG. 7 may be stored in a ROM or the like as a control program including steps capable of executing the process exemplarily shown in FIG. 7. The control program stored in the ROM or the like may be executed by a CPU. Further, a part or all of the process may be achieved only by hardware.

As described above, according to the second embodiment of the present invention, an effect similar to that in the first embodiment of the present invention may be obtained.

Modified Second Embodiment

In this modified second embodiment, more accurate length of the to-be-transferred object may be obtained when compared with that in the second embodiment. Specifically, in the process of FIG. 6, when the result of the determination in step S610 is NO, instead of setting the sum "c'" of the feeding distances to be zero (c'=0), a difference between the sum "c'" of the feeding distances and the one-pulse feeding distance "a" is input to the sum "c'" of the feeding distances (c'=c'−a).

Figure 8:
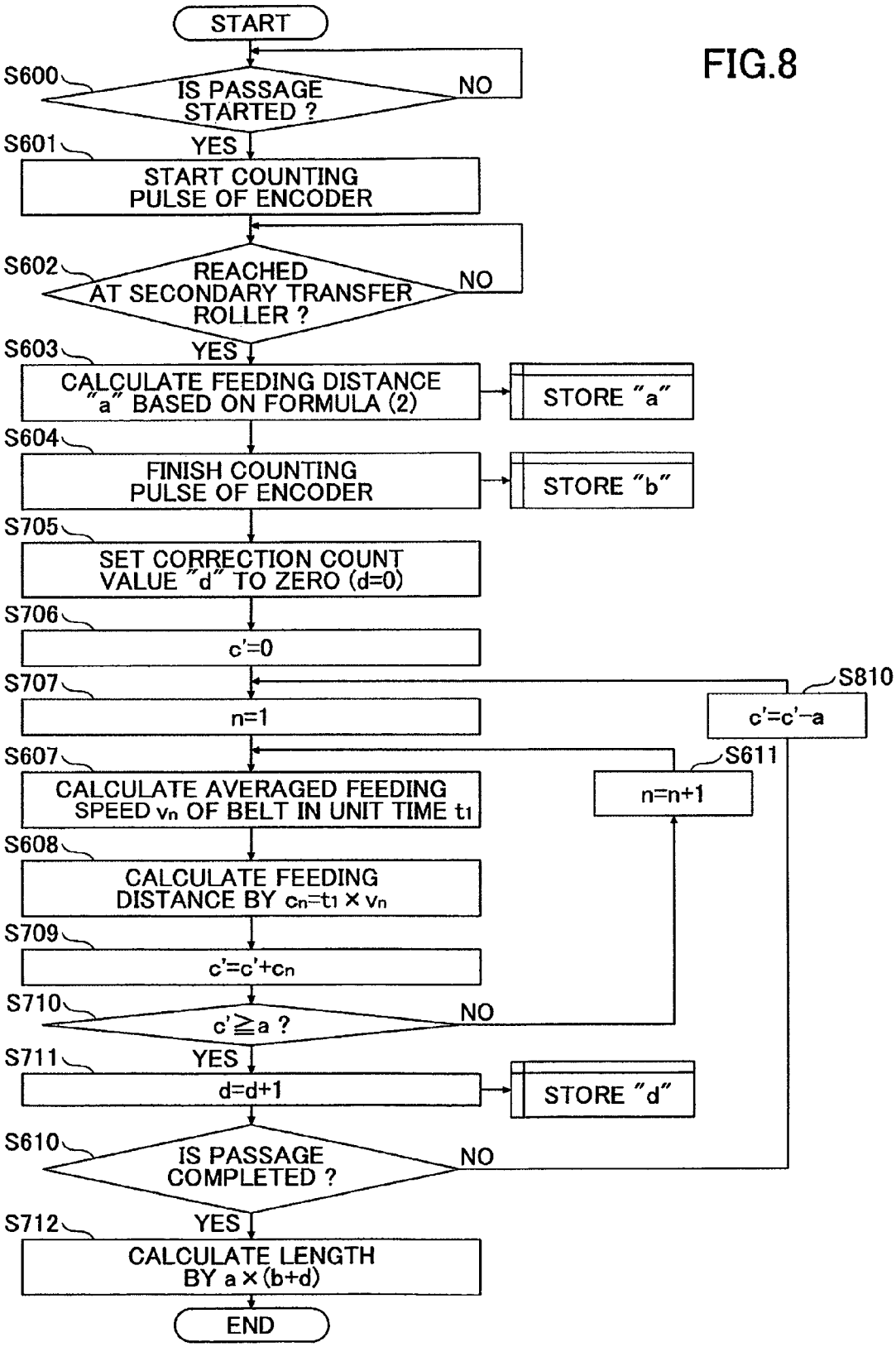
FIG. 8 is a flowchart showing a process of measuring the length of the to-be-transferred object according to a modified second embodiment of the present invention.

FIG. 8 is a flowchart showing still another process of measuring the length of the to-be-transferred object according to this modified second embodiment of the present invention. In FIG. 8, the same reference numerals are used for the same steps in FIG. 7, and the descriptions thereof may be omitted. First, the process of steps S600 through S610 is executed. In step S610, when determining that the completion of the passage of the to-be-transferred object 90 is not detected (NO in step S610), the process goes to step S810. In step S810, the difference between the sum "c'" of the feeding distances and the one-pulse feeding distance "a" is input (set) to the sum "c'" of the feeding distances (c'=c'−a). Then, the process goes back to step S707 to execute the process of steps S707 through S711. In step S610, when determining that the completion of the passage of the to-be-transferred object 90 is detected (YES in step S610), the process goes to step S712 to execute the process similar to that in step S712 in FIG. 7.

As described above, according this modified second embodiment of the present invention, when the sum "c'" of the feeding distances is equal to or greater than the one-pulse feeding distance "a", the difference between the sum "c'" of the feeding distances and the one-pulse feeding distance "a" is input (set) to the initial value of the next sum "c'" of the feeding distances. In other words, the difference between the sum "c'" of the feeding distances and the one-pulse feeding distance "a" is added to the initial value of the next sum "c'" of the feeding distances. Because of this feature, it may become possible to count up the correction count value "d" by considering the difference. Therefore, in this modified second embodiment, it may become possible to obtain more accurate length of the to-be-transferred object when compared with the second embodiment of the present invention.

Further, the process exemplarily shown in FIG. 8 may be stored in a ROM or the like as a control program including steps capable of executing the process exemplarily shown in FIG. 8. The control program stored in the ROM or the like may be executed by a CPU. Further, a part or all of the process may be achieved only by hardware.

Third Embodiment

In the third embodiment of the present invention, an example using a method of measuring the length of the to-be-transferred object different from that used in the first embodiment of the present invention is described. Specifically, in the second measurement period, instead of calculating the feeding distance "$c_n$" of the to-be-transferred object 90 per unit time "$t_1$", a feeding distance "e" in the second measurement period is calculated using an elapsed time period "$t_m$" in the second measurement period and an averaged feeding speed $V_m$ corresponding to the elapsed time period "$t_m$".

Further, a configuration of the image forming apparatus according to this third embodiment is similar to that in the first embodiment of the present invention. Therefore, the description thereof is omitted.

Figure 9:
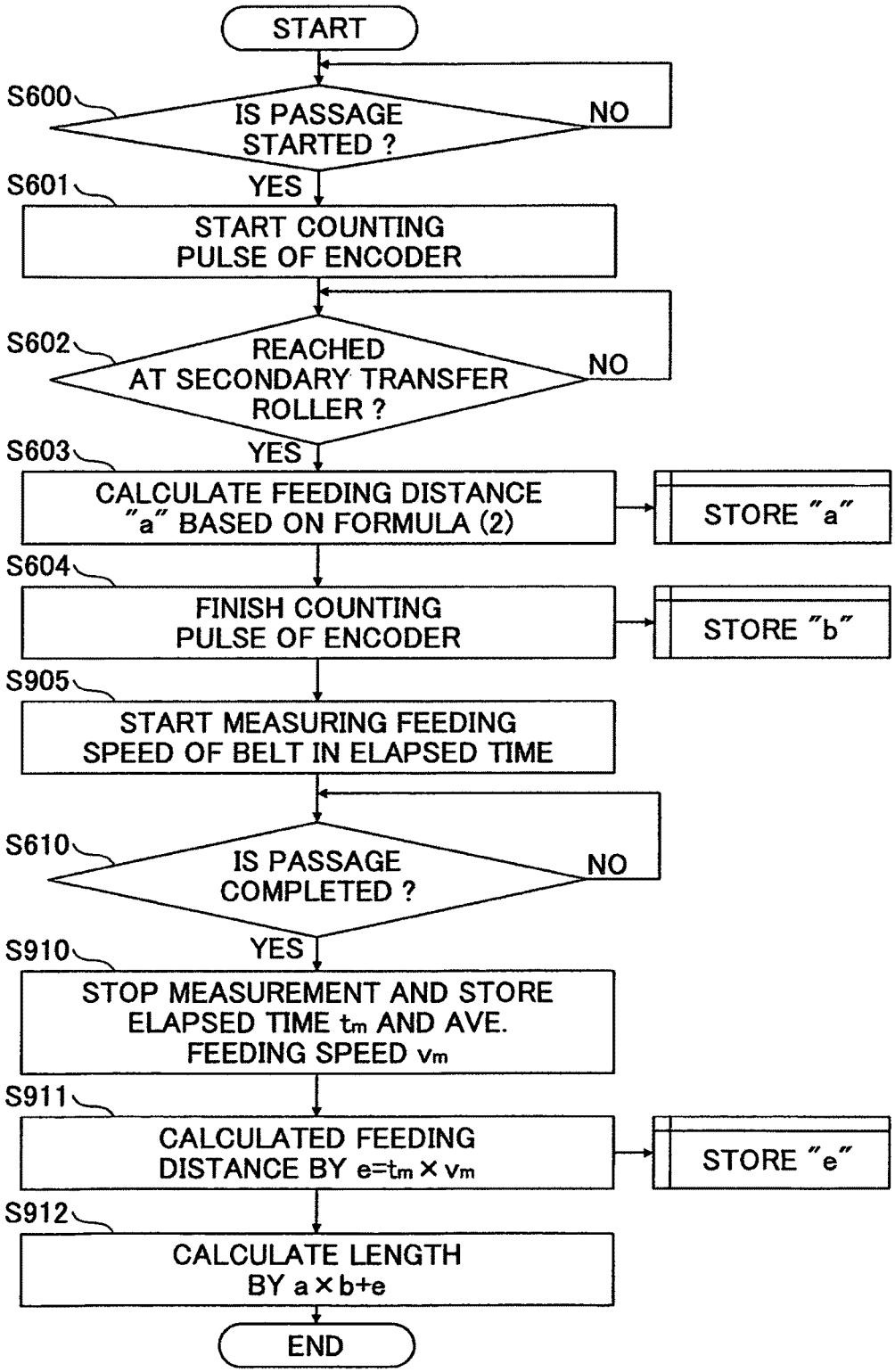
FIG. 9 is a flowchart showing a process of measuring the length of the to-be-transferred object according to a third embodiment of the present invention.

FIG. 9 is a flowchart showing still another process of measuring the length of the to-be-transferred object according to the third embodiment of the present invention. In FIG. 9, the same step numbers are used for the same steps in FIG. 6, and the descriptions thereof may be omitted. First, the process of steps S600 through S604 is executed.

Next, in step S905, the control section 30 starts measuring an elapsed time period since the control section 30 has stopped counting the number of pulses of the pulse signal from the encoder 17*a* in step S604 and an averaged feeding speed of the intermediate transfer belt 14 in the elapsed time period. Next, a process similar to that in step S610 in FIG. 6 is executed. In step S610, when determining that the completion of the passage of the to-be-transferred object 90 is not detected (NO in step S610), the process of step S610 is repeated. In step S610, when determining that the completion of the passage of the to-be-transferred object 90 is detected (YES in step S610), the process goes to step S910. In step S910, the control section 30 stops measuring the elapsed time period and the averaged feeding speed of the intermediate transfer belt 14 in the elapsed time period, and stores the measured elapsed time period as the elapsed time period "$t_m$" and the measured averaged feeding speed as the averaged feeding speed $V_m$ (step S910). When the completion of the passage of the to-be-transferred object 90 is detected, the second measurement period is terminated.

Next, in step S911, the control section 30 calculates the feeding distance "e" in the second measurement period using the elapsed time period "$t_m$" in the second measurement period and the averaged feeding speed $V_m$ corresponding to the elapsed time period "$t_m$" based on the following formula (6).

$$\text{Feeding distance "}e\text{"} = (\text{elapsed time period "}t_m\text{"}) \times (\text{averaged feeding speed } V_m) \quad \text{formula (6)}$$

Further, in the step S911, the control section 30 stores the calculated feeding distance "e" (step S911).

Next, in step S912, the control section 30 calculates the length of the to-be-transferred object 90 based on the following formula (7) using the one-pulse feeding distance "a" stored in step S603, the pulse count No. "b" stored in step S604, and the feeding distance "e" stored in step S911 (steps S912).

$$\text{Length of the to-be-transferred object 90} = (\text{one-pulse feeding distance "}a\text{"}) \times (\text{pulse count No. "}b\text{"}) + (\text{feeding distance "}e\text{"}) \quad \text{formula (7)}$$

As described above, the length of the to-be-transferred object 90 may be obtained by adding the first feeding distance (one-pulse feeding distance "a"×pulse count No. "b") of the to-be-transferred object 90 in the first measurement period to the second feeding distance (feeding distance "e") of the to-be-transferred object 90 in the second measurement period.

Further, the process exemplarily shown in FIG. 9 may be stored in a ROM or the like as a control program including steps capable of executing the process exemplarily shown in FIG. 9. The control program stored in the ROM or the like may be executed by a CPU. Further, a part or all of the process may be achieved only by hardware.

As described above, according to the third embodiment of the present invention, an effect similar to that in the first embodiment of the present invention may be obtained.

Fourth Embodiment

In the forth embodiment of the present invention, an example is described where, instead of using the encoder 17*a* in the first embodiment of the present invention, a rotation angle detection mechanism 40 is used. The configuration the rotation angle detection mechanism 40 in the image forming apparatus according to the fourth embodiment of the present invention is similar to the image forming apparatus 10 in the first embodiment of the present invention. Therefore, the description of the similar parts is herein omitted.

Figure 10:
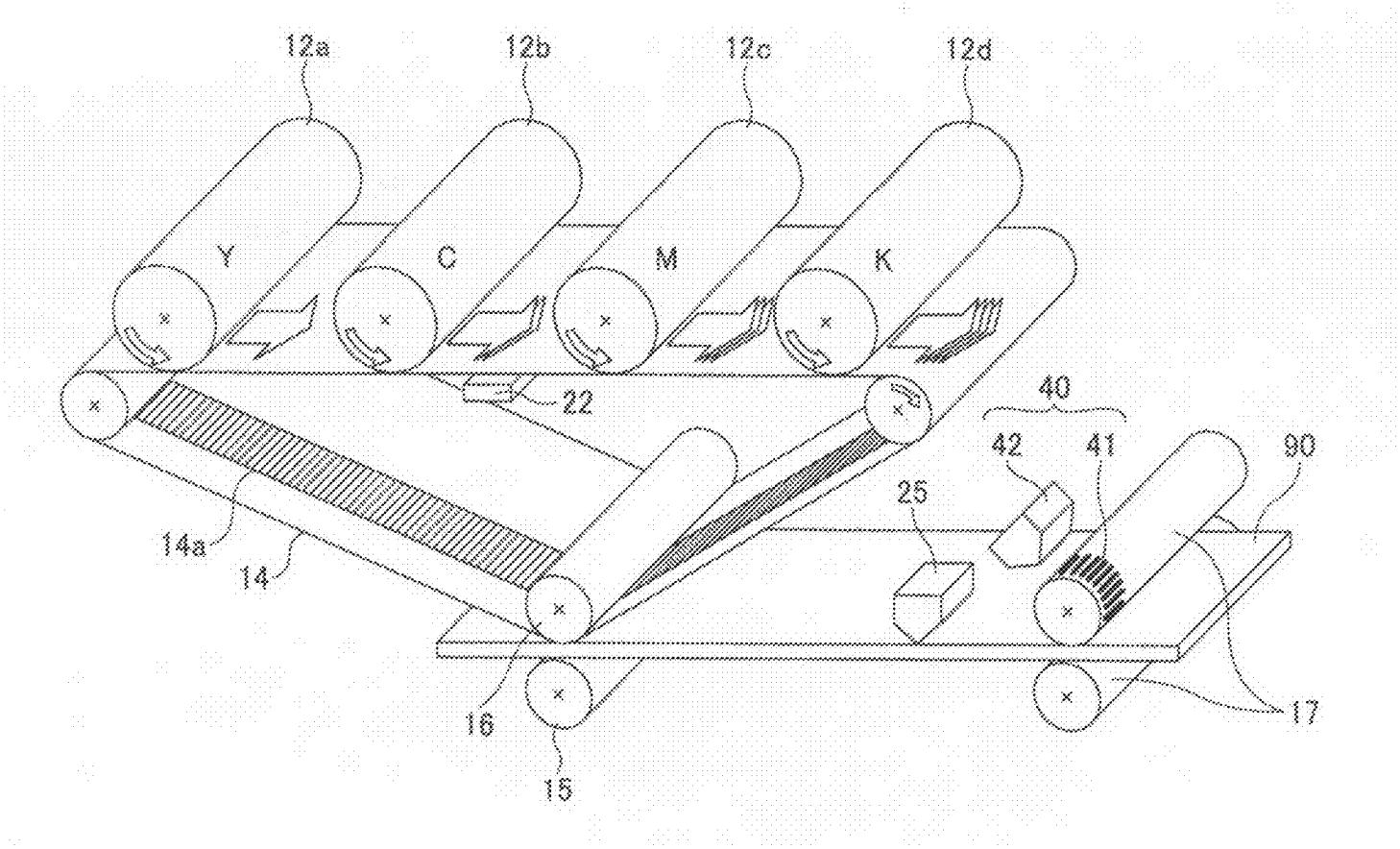
FIG. 10 is a drawing illustrating an exemplary configuration of a rotation angle detection mechanism according to a fourth embodiment of the present invention.

FIG. 10 shows an exemplary configuration of a rotation angle detection mechanism according to the fourth embodiment of the present invention. In FIG. 10, the same reference numerals are used for the same or similar components in FIG. 1, and the descriptions thereof may be omitted. As shown in FIG. 10, the rotation angle detection mechanism 40 includes a scale 41 provided (formed) on the feed roller 17 and a scale detection sensor 42 configured to detect indications of the scale 41.

The scale 41 includes the indications, more specifically, reflection parts and non-reflecting parts alternately disposed at predetermined intervals, along the circumferential direction of the feed roller 17. The scale detection sensor 42 is disposed near the scale 41, and is configured to detect the indications of the scale 41 and output a pulse signal as a pulse signal output unit. The scale detection sensor 42 includes, for example, a light-emitting device, a light-receiving device, and a pulse generation section (not shown). In this case, the light-emitting section emits light onto the scale 41; the light-receiving device receives light reflected from the scale 41 and generates an electric signal in accordance with the amount of the received (reflected) light; and the pulse generation section generates a pulse signal based on the electric signal generated by the light-receiving device. Further, the light-emitting device, the light-receiving device, and the pulse generation section may be integrated together or separated from one another.

The combination of the scale 41 and the scale detection sensor 42 is configured to output a pulse signal in accordance with the rotation of the feed roller 17, and may be a representative example of a rotation angle measurement unit of the present invention. The control section 30 may measure the rotation amount of the feed roller 17 by counting the number of pulses of the pulse signal output from the scale detection sensor 42. Namely, the scale 41, the scale detection sensor 42, and the control section 30 may be representative components of the rotation amount measurement unit of the present invention.

As described above, according to the fourth embodiment of the present invention, an effect similar to that in the first embodiment of the present invention may be obtained.

Fifth Embodiment

In the fifth embodiment of the present invention, an example using a method of measuring the length of the to-be-transferred object different from that used in the first embodiment of the present invention is described. In the first embodiment, the example is described in which the length of the to-be-transferred object is obtained using the feeding speed of the intermediate transfer belt 14 (=rotating speed of the secondary transfer roller 15=feeding speed of the to-be-transferred object). On the other hand, in the fifth embodiment of the present invention, an example is described in which the length of the to-be-transferred object is obtained using a dedicated feeding distance measurement unit 50. The configuration other than the feeding distance measurement unit 50 in the image forming apparatus according to the fifth embodiment of the present invention is similar to the image forming apparatus 10 in the first embodiment of the present invention. Therefore, the description of the similar parts is herein omitted.

Figure 11:
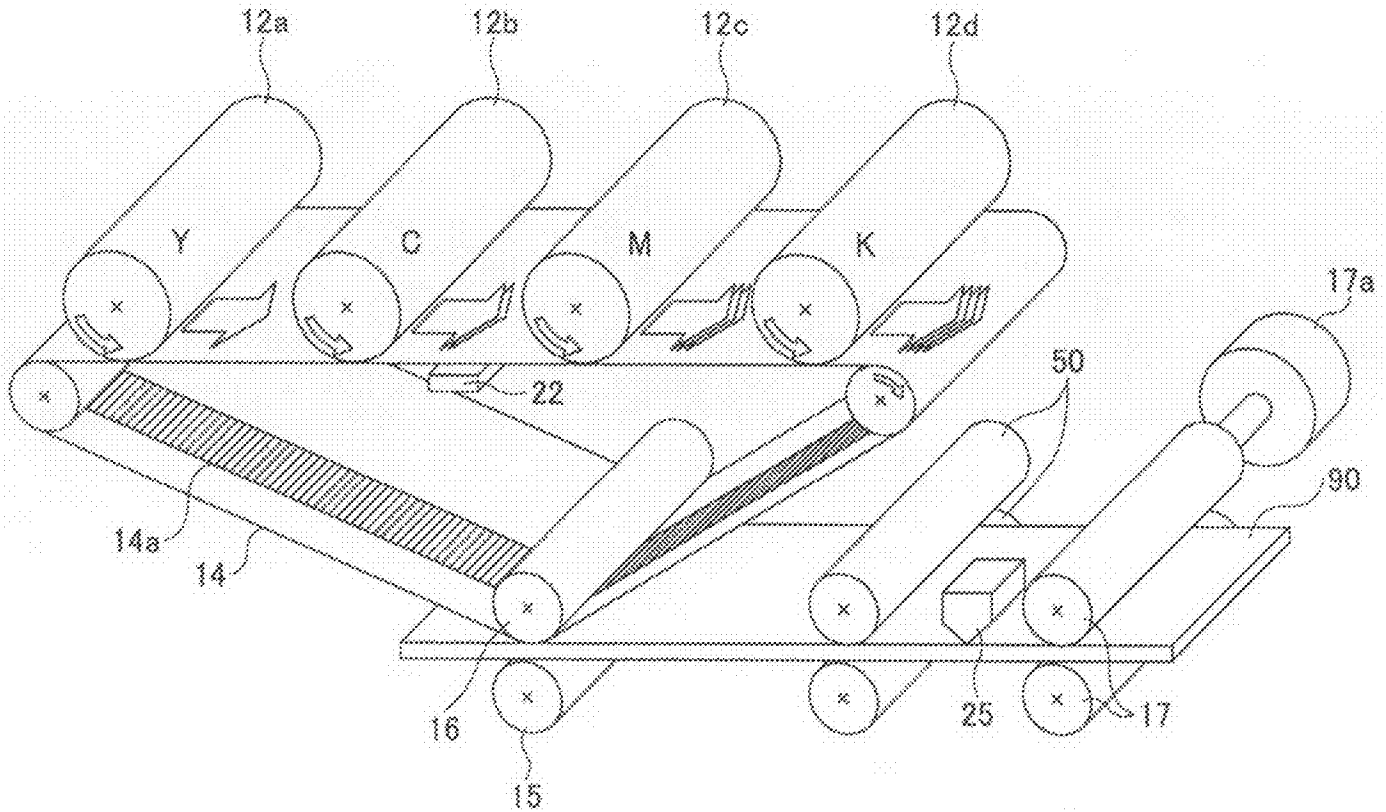
FIG. 11 is a drawing illustrating an exemplary configuration of a feeding distance measurement unit according to a fifth embodiment of the present invention.

FIG. 11 shows an exemplary configuration of the feeding distance measurement unit 50 according to the fifth embodiment of the present invention. In FIG. 11, the same reference numerals are used for the same or similar components in FIG. 1, and the descriptions thereof may be omitted. As shown in FIG. 11, the feeding distance measurement unit 50 includes a pair of rotating bodies like feed rollers 17. The feeding distance measurement unit 50 is made of a material that is less likely to be thermally expanded than that used in the feed rollers 17 and the secondary transfer roller 15. The feeding distance measurement unit 50 is driven to be rotated by a motor (not shown). For example, the feeding distance measurement unit 50 includes an encoder to detect the rotation angle of the feeding distance measurement unit 50, so that the feeding distance of the to-be-transferred object 90 is measured based on the output from the encoder. Instead of using the encoder, the rotation angle detection mechanism 40 described in the third embodiment of the present invention may be used. Further, instead of using the encoder, the speed may be detected base on a current (or current×torque coefficient/inertia) flowing in the motor.

The control section 30 may measure the feeding speed of the to-be-transferred object 90 based on the output from the feeding distance measurement unit 50. Namely, the feeding distance measurement unit 50 may be a representative example of a to-be-transferred object feeding speed measurement unit.

As described above, according to the fifth embodiment of the present invention, an effect similar to that in the first embodiment of the present invention may be obtained. Further, additional effect described below may also be obtained. Namely, in the measurement of the feeding speed of the to-be-transferred object, the feeding speed of the intermediate transfer belt is not used. Because of this feature, it may become possible to measure the length of the to-be-transferred object regardless of the position of the feeding distance measurement unit 50 in the feeding path of the to-be-transferred object 90.

Figure 12:
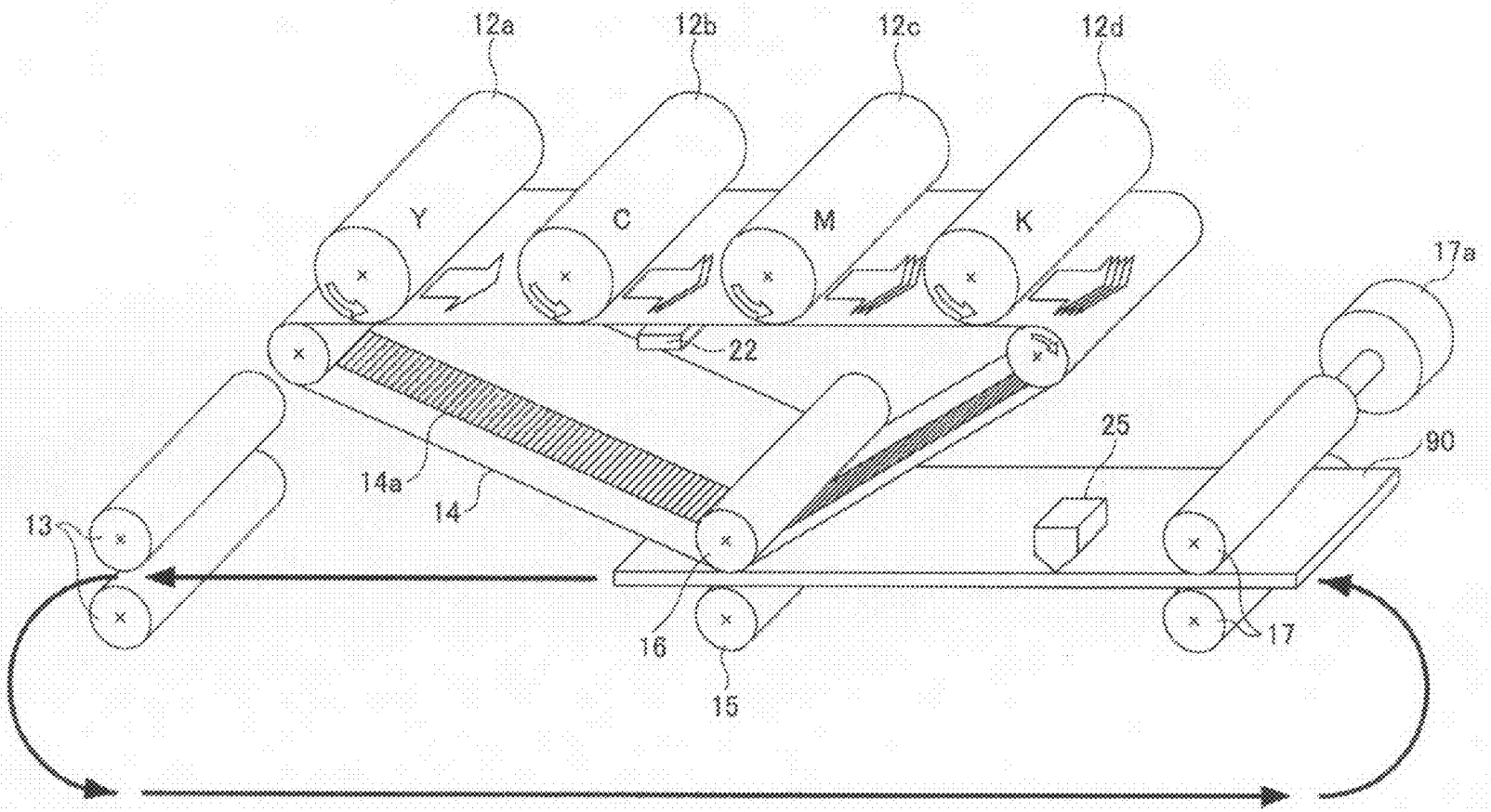
FIG. 12 is a schematic drawing illustrating a measurement of an expansion and contraction rate of the to-be-transferred object.

Further, in an image forming apparatus according to any of the first through the fifth embodiments of the present invention, an expansion-contraction rate of the to-be-transferred object may be measured. In the following, with reference to FIG. 12, a measurement of the expansion-contraction rate is described. FIG. 12 schematically illustrates the measurement of the expansion and contraction rate of the to-be-transferred object 90. In FIG. 12, the same reference numerals are used for the same or similar components in FIG. 1, and the descriptions thereof may be omitted. As shown in FIG. 12, when double-side printing is performed, first, a toner image is transferred onto a first surface (front surface) of the to-be-transferred object 90. Then, the toner image is fixed by the fixing unit 13 (hereinafter referred to as a first fixing). Next, the to-be-transferred object 90 passes through a double-side feeding path, and another toner image is transferred onto a second surface (rear surface) of the to-be-transferred object 90 by a secondary transfer section. Then, the toner image is fixed by the fixing unit 13, and the to-be-transferred object 90 is discharged.

However, the to-be-transferred object 90 may be expanded or contracted due to (during) the first fixing. As a result, in the to-be-transferred object 90, the magnification ratio in the front surface may differ from that in the rear surface. To overcome the difference, the magnification ratio may be adjusted by using the expansion and contraction rate of the to-be-transferred object due to the first fixing by the fixing unit 13. In this case, the expansion and contraction rate of the to-be-transferred object may be calculated based on the following formula (8).

Expansion-contraction rate of the to-be-transferred object 90 [%]=(length of the to-be-transferred object 90 after the passage through the fixing unit 13)/(length of the to-be-transferred object 90 before the passage through the fixing unit 13) formula (8)

Further, in a case where the length of the to-be-transferred object 90 is measured using the method in the second embodiment of the present invention, the expansion-contraction rate of the to-be-transferred object 90 may be obtained based on the following formula (9) using the pulse count No. "b" and the correction count value "d".

Expansion-contraction rate of the to-be-transferred object 90 [%]=("*b*"+"*d*" after the passage through the fixing unit 13)/("*b*"+"*d*" before the passage through the fixing unit 13) formula (9)

As described above, by measuring the expansion-contraction rate of the to-be-transferred object, it may become possible to more accurately perform the double-side printing.

According to an embodiment of the present invention, it may become possible to provide a to-be-transferred object length measurement device capable of measuring the length of the to-be-transferred object on which an image is transferred even when the diameter of the roller fluctuates due to the eccentricity and thermal expansion of the feeding roller and the like, and an image forming apparatus and a computer program using such a to-be-transferred object length measurement device.

Although the invention has been described with respect to specific embodiments and a modification for a complete and clear disclosure, the appended claims are not to be thus limited but are to be construed as embodying all modifications and alternative constructions that may occur to one skilled in the art that fairly fall within the basic teaching herein set forth.

For example, the present invention may be applied to a color copier having a scanner unit. However, the present invention may also be applied to apparatuses such as a printer configured to receive image data from an external controller such as a PC and form an image based on the image data.

Further, in any of the first through the fifth embodiments of the present invention, for example, as the first rotating body, instead of using the feed rollers 17, a feed belt may be used. In this case, instead of the encoder 17*a*, the feed belt may be equipped with a scale similar to the intermediate belt scale 14*a*. Further, a sensor similar to the intermediate transfer scale detection sensor 22 may be disposed near the feed belt. By doing this, the rotation amount of the feed belt may be measured.

Further, in any of the first through the fifth embodiments of the present invention, as the second rotating body, instead of using the intermediate transfer belt 14, an intermediate transfer drum may be used.

What is claimed is:

1. An object length measurement device, comprising:

a first rotating body configured to feed an object;

a passage detection unit disposed on a downstream side of the first rotating body, and configured to detect a passage of the object at a set position in an object feeding path;

a rotation amount measurement unit configured to measure a rotation amount of the first rotating body in a first measurement period from when the passage detection unit starts detecting the passage of the object at the set position to a set timing before the first rotating body completes feeding the object;

a second rotating body disposed on a downstream side of the first rotating body and the passage detection unit, and configured to feed the object after the first rotating body feeds the object;

a speed detection unit configured to detect a first feeding speed of the object while the object is fed by the first rotating body, and configured to detect a second feeding speed of the object in a second measurement period from the set timing to when the passage detection unit detects a completion of the passage of the object at the set position; and a calculation unit configured to calculate a feeding distance of the object per a set rotation amount of the first rotating body based on the first feeding speed of the object while the object is fed by the first rotating body, and configured to calculate a length of the object based on the rotation amount of the first rotating body in the first measurement period, the feeding distance, and the second feeding speed of the object in the second measurement period.

2. The object length measurement device according to claim 1, wherein the calculation unit calculates the length of the object by adding a first feeding distance of the object in the first measurement period to a second feeding distance of the object in the second measurement period, the first feeding distance being obtained by multiplying the feeding distance of the object per the set rotation amount by a number of the set rotation amounts in the first measurement period, the second feeding distance being obtained based on the second measurement period and the second feeding speed of the object in the second measurement period.

3. The object length measurement device according to claim 2, wherein the calculation unit divides the second measurement period into plural time slots and divides the second feeding speed into a plural time slot feeding speeds, calculates the feeding distances of all the time slots based on the respective time slot feeding speeds, and sums all the feeding distances of the plural time slots to calculate the second feeding distance of the object in the second measurement period.

4. The object length measurement device according to claim 1, wherein the calculation unit calculates a correction count value by counting the second feeding distance of the object in the second measurement period by using the feeding distance of the object per the set rotation amount as a unit, based on the second feeding speed of the object in the second measurement period and the feeding distance of the object per the set rotation amount, and calculates the length of the object by multiplying a sum of a number of the set rotation amounts in the first measurement period and the correction count value by the feeding distance of the object per the set rotation amount.

5. The object length measurement device according to claim 1, wherein the rotation amount measurement unit includes a rotation angle measurement unit configured to measure a rotation angle of the first rotating body, wherein the rotation amount measurement unit measures the rotation amount of the first rotating body based on a measurement result of the rotation angle measurement unit.

6. The object length measurement device according to claim 5, wherein the rotation angle measurement unit is attached to the first rotating body and includes a pulse signal output unit, configured to output a pulse signal in accordance with a rotation of the first rotating body.

7. The object length measurement device according to claim 5, wherein the rotation angle measurement unit includes a scale and a pulse signal output unit, the scale being formed on the first rotating body, the pulse signal output unit being configured to detect the scale and output a pulse signal in accordance with a rotation of the first rotating body.

8. The object length measurement device according to claim 6, wherein the feeding distance of the object per the set rotation amount is a feeding distance of the object per a single pulse output from the pulse signal output unit.

9. The object length measurement device according to claim 6, wherein the number of the set rotation amounts in the first measurement period is a number of pulses of the pulse signal output from the pulse signal output unit.

10. The object length measurement device according to claim 8, wherein the feeding distance of the object per a single pulse of the pulse signal is obtained by dividing a first value by a second value, a first value being obtained by multiplying the first feeding speed of the object while the object is fed by the first rotating body by a set time period, the second value being a number of pulses output by the pulse signal output unit in the set time period.

11. The object length measurement device according to claim 1, wherein the second rotating body is equipped with a scale, and the speed detection unit measures a feeding speed of the object based on a number of indications of the scale detected in a set time period.

12. The object length measurement device according to claim 1, wherein the speed detection unit includes a third rotating body disposed on a downstream side of the passage detection unit in a manner such that a leading end of the object reaches the speed detection unit while the object is being fed by the first rotating body, and the third rotating body is made of a material that is less likely to be thermally expanded than that of the first rotating body and the second rotating body.

13. The object length measurement device according to claim 1, further comprising:

an adjustment unit configured to adjust a feeding speed or a feeding torque of the first rotating body and the second rotating body while the object is being fed by the first rotating body and the second rotating body.

14. The object length measurement device according to claim 1, further comprising:

an expansion-contraction rate calculation unit configured to calculate an expansion-contraction rate of the object.

15. An image forming apparatus comprising:

the object length measurement device according to claim 1.

16. The image forming apparatus according to claim 15, further comprising:

a fixing unit configured to fix an image transferred onto the object; and an expansion-contraction rate calculation unit configured to calculate an expansion-contraction rate of the object based on a comparison between the length of the object before the object passes through the fixing unit, the length being calculated by the calculation unit, and the length of the object after the object has passed through the fixing unit, the length being calculated by the calculation unit.

17. An image forming apparatus comprising:

the object length measurement device according to claim 4;

a fixing unit configured to fix an image transferred onto the object; and an expansion-contraction rate calculation unit configured to calculate an expansion-contraction rate of the object based on a comparison between a first value and a second value, the first value being calculated by adding the number of the set rotation amounts in the first measurement period before the object passes through the fixing unit to the correction count value, the second value being calculated by adding the number of the set rotation amounts in the first measurement period after the object passed through the fixing unit to the correction count value.

18. A non-transitory computer-readable storage medium with an executable program stored thereon, wherein the program causing an apparatus to execute steps of a object length measurement method, the method comprising:

feeding an object by a first rotating body;

detecting a passage of the object at a set position in an object feeding path;

measuring a rotation amount of the first rotating body in a first measurement period from when starting to detect the passage of the object at the set position to a set timing before the first rotating body completes feeding the object;

feeding the object after the first rotating body feeds the object by a second rotating body;

detecting a first feeding speed of the object while the object is fed by the first rotating body;

detect a second feeding speed of the object in a second measurement period from the set timing to detecting a completion of the passage of the object at the set position;

calculating a feeding distance of the object per a set rotation amount of the first rotating body based on the first feeding speed of the object while the object is fed by the first rotating body; and calculating a length of the object based on the rotation amount of the first rotating body in the first measurement period, the feeding distance, and the second feeding speed of the object in the second measurement period.

* * * * *

UNITED STATES PATENT AND TRADEMARK OFFICE

CERTIFICATE OF CORRECTION

PATENT NO. : 8,639,174 B2
APPLICATION NO. : 12/659716
DATED : January 28, 2014
INVENTOR(S) : Ashikawa et al.

It is certified that error appears in the above-identified patent and that said Letters Patent is hereby corrected as shown below:

On the Title Page, Item (75) Inventors: Takuro Kamiyai should read (75) - Takuro Kamiya Signed and Sealed this
Seventeenth Day of June, 2014

Michelle K. Lee

Michelle K. Lee
*Deputy Director of the United States Patent and Trademark Office*